US011545124B2

(12) United States Patent
Kimura et al.

(10) Patent No.: US 11,545,124 B2
(45) Date of Patent: Jan. 3, 2023

(54) ELECTRONIC PERCUSSION INSTRUMENT AND MUSICAL SOUND GENERATING METHOD

(71) Applicant: Roland Corporation, Shizuoka (JP)

(72) Inventors: Toshiharu Kimura, Shizuoka (JP); Kiyoshi Yoshino, Shizuoka (JP)

(73) Assignee: Roland Corporation, Shizuoka (JP)

( * ) Notice: Subject to any disclaimer, the term of this patent is extended or adjusted under 35 U.S.C. 154(b) by 94 days.

(21) Appl. No.: 17/083,269

(22) Filed: Oct. 28, 2020

(65) Prior Publication Data

US 2021/0201876 A1 Jul. 1, 2021

(30) Foreign Application Priority Data

Dec. 26, 2019 (JP) ..... JP2019-237440

(51) Int. Cl.

| | |
|---|---|
| ***G10H 3/14*** | (2006.01) |
| ***G10D 13/10*** | (2020.01) |
| ***G10D 13/02*** | (2020.01) |

(52) U.S. Cl.

CPC ..... *G10H 3/146* (2013.01); *G10D 13/02* (2013.01); *G10D 13/26* (2020.02); *G10H 2220/525* (2013.01)

(58) Field of Classification Search

CPC .. G10H 3/146; G10H 2220/525; G10D 13/26; G10D 13/02

See application file for complete search history.

(56) References Cited

U.S. PATENT DOCUMENTS

| | | | | |
|---|---|---|---|---|
| 3,553,339 | A | 1/1971 | Dominguez et al. | |
| 5,920,026 | A | 7/1999 | Yoshino et al. | |
| 6,601,436 | B1 | 8/2003 | Senda et al. | |
| 8,940,991 | B2 * | 1/2015 | Shemesh | G10H 3/146 84/615 |
| 9,164,605 | B1 * | 10/2015 | Pirogov | G06F 3/04144 |

(Continued)

FOREIGN PATENT DOCUMENTS

| | | |
|---|---|---|
| EP | 3531414 | 8/2019 |
| JP | 2001255871 | 9/2001 |

(Continued)

OTHER PUBLICATIONS

"Office Action of Europe Counterpart Application", dated Dec. 22, 2021, p. 1-p. 6.

(Continued)

*Primary Examiner* — Jianchun Qin

(74) *Attorney, Agent, or Firm* — JCIPRNET

(57) ABSTRACT

An electronic percussion instrument capable of simulating a rendition of an acoustic percussion instrument is provided. The electronic percussion instrument includes a housing, a percussion surface attached to the housing, a pressure sensor disposed on a central section of the percussion surface on a side of the back surface and configured to detect pressing against the central section, a head vibration sensor disposed on a peripheral section of the percussion surface on the side of the back surface and configured to detect vibrations of the peripheral section, and a rim vibration sensor disposed at a position overlapping the head vibration sensor when seen in a plan view of the percussion surface and configured to detect vibrations of the housing.

13 Claims, 11 Drawing Sheets

(56) References Cited

U.S. PATENT DOCUMENTS

| | | | | |
|---|---|---|---|---|
| 9,263,020 | B2 | 2/2016 | Takasaki | |
| 2006/0219092 | A1 | 10/2006 | Mishima | |
| 2013/0340596 | A1 | 12/2013 | Yao | |
| 2014/0020548 | A1 | 1/2014 | Shemesh | |
| 2018/0025711 | A1* | 1/2018 | Bhamra | G10H 1/0066 84/600 |
| 2018/0061387 | A1* | 3/2018 | Takasaki | G10H 3/146 |
| 2018/0061388 | A1 | 3/2018 | Takasaki et al. | |

FOREIGN PATENT DOCUMENTS

| | | |
|---|---|---|
| JP | 2004240463 | 8/2004 |
| WO | 2019021405 | 1/2019 |

OTHER PUBLICATIONS

"Search Report of Europe Counterpart Application", dated Apr. 7, 2021, p. 1-p. 10.

* cited by examiner (a)

(b)

ELECTRONIC PERCUSSION INSTRUMENT AND MUSICAL SOUND GENERATING METHOD

CROSS-REFERENCE TO RELATED APPLICATION

This application claims the priority benefits of Japan Patent Application No. 2019-237440, filed on Dec. 26, 2019. The entirety of the above-mentioned patent application is hereby incorporated by reference herein and made a part of this specification.

BACKGROUND

Technical Field

The disclosure relates to an electronic percussion instrument, and more particularly, to an electronic percussion instrument and a musical sound generating method that are capable of simulating a rendition of an acoustic percussion instrument.

Description of Related Art

An electronic percussion instrument such as electronic drums or the like having a housing to which a percussion surface is attached includes a pressure sensor configured to detect pressing on the percussion surface (a pressure received by the percussion surface upon percussion), and a piezo-sensor configured to detect vibrations of the housing (Patent Document 1). Patent Document 1 discloses a musical sound generating method of calculating a percussion position on a percussion surface according to an output value of a pressure sensor and an output value of a piezo-sensor, and generating musical sound according to the percussion position.

PATENT DOCUMENTS

[Patent Document 1] Japanese Patent Laid-Open No. 2001-255871

SUMMARY

However, in an electronic percussion instrument in the related art having only a pressure sensor configured to detect pressing against a percussion surface, and a piezo-sensor configured to detect vibrations of a housing, it may not be possible to simulate various rendition methods of an acoustic percussion instrument. For example, when the percussion surface is percussed with the hands, when percussion positions (range) are more widespread in comparison with the case in which the percussion surface is percussed with a stick, in an electronic percussion instrument or a musical sound generating method in the related art, it may be difficult to identify widespread percussion positions with respect to the hands, and it may be difficult to generate musical sound according to these widespread percussion positions. That is, in the electronic percussion instrument or the musical sound generating method in the related art, it may not be possible to simulate a rendition of percussing a percussion surface with the hands.

In order to solve these problems, the disclosure provides an electronic percussion instrument and a musical sound generating method that are capable of simulating a rendition of an acoustic percussion instrument.

In order to accomplish the above-mentioned purposes, the disclosure provides an electronic percussion instrument including a housing, a percussion surface attached to the housing, a pressure sensor disposed on a central section of the percussion surface on a side of a back surface and configured to detect pressing against the central section, a head vibration sensor disposed on a peripheral section of the percussion surface on the side of the back surface and configured to detect vibrations of the peripheral section, and a rim vibration sensor disposed at a position that overlaps the head vibration sensor when seen in a plan view of the percussion surface and configured to detect vibrations of the housing.

The disclosure provides a musical sound generating method of outputting a sound producing instruction according to a percussion position on a percussion surface attached to a housing of an electronic percussion instrument, the musical sound generating method including: a position calculating process of calculating the percussion position on the percussion surface according to an output value of a pressure sensor configured to detect pressing against the percussion surface, an output value of a head vibration sensor configured to detect vibrations of the percussion surface, and an output value of a rim vibration sensor configured to detect vibrations of the housing.

Figure 4:
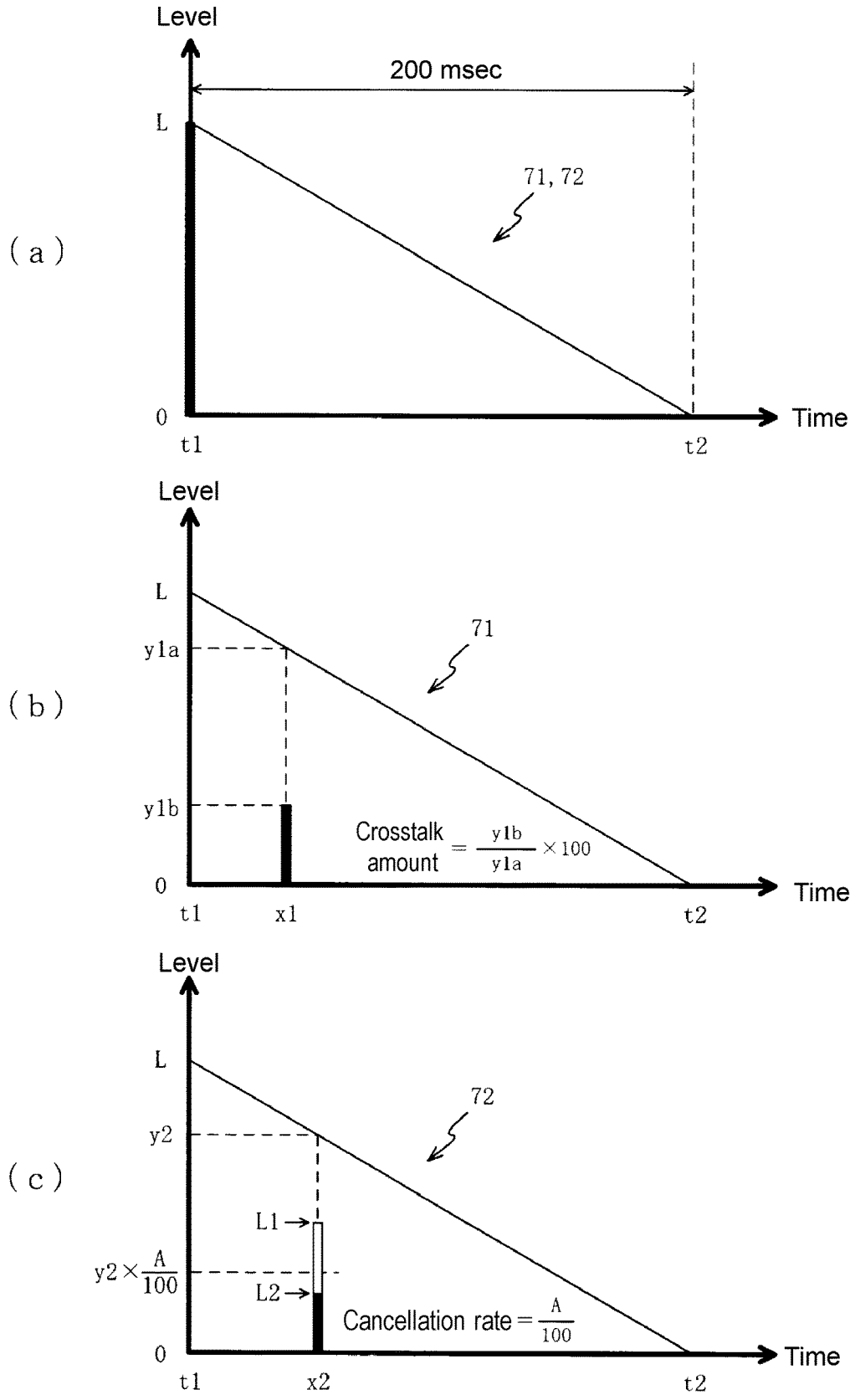

(a) of FIG. 4 is a schematic view showing a shape of an envelope for calculating a crosstalk amount and an envelope for cancelling out crosstalk, (b) of FIG. 4 is a view for describing a method of calculating a crosstalk amount using the envelope for calculating a crosstalk amount, and (c) of FIG. 4 is a view for describing a method of determining crosstalk cancelling out performed using the envelope for cancelling out crosstalk.

Figure 5:
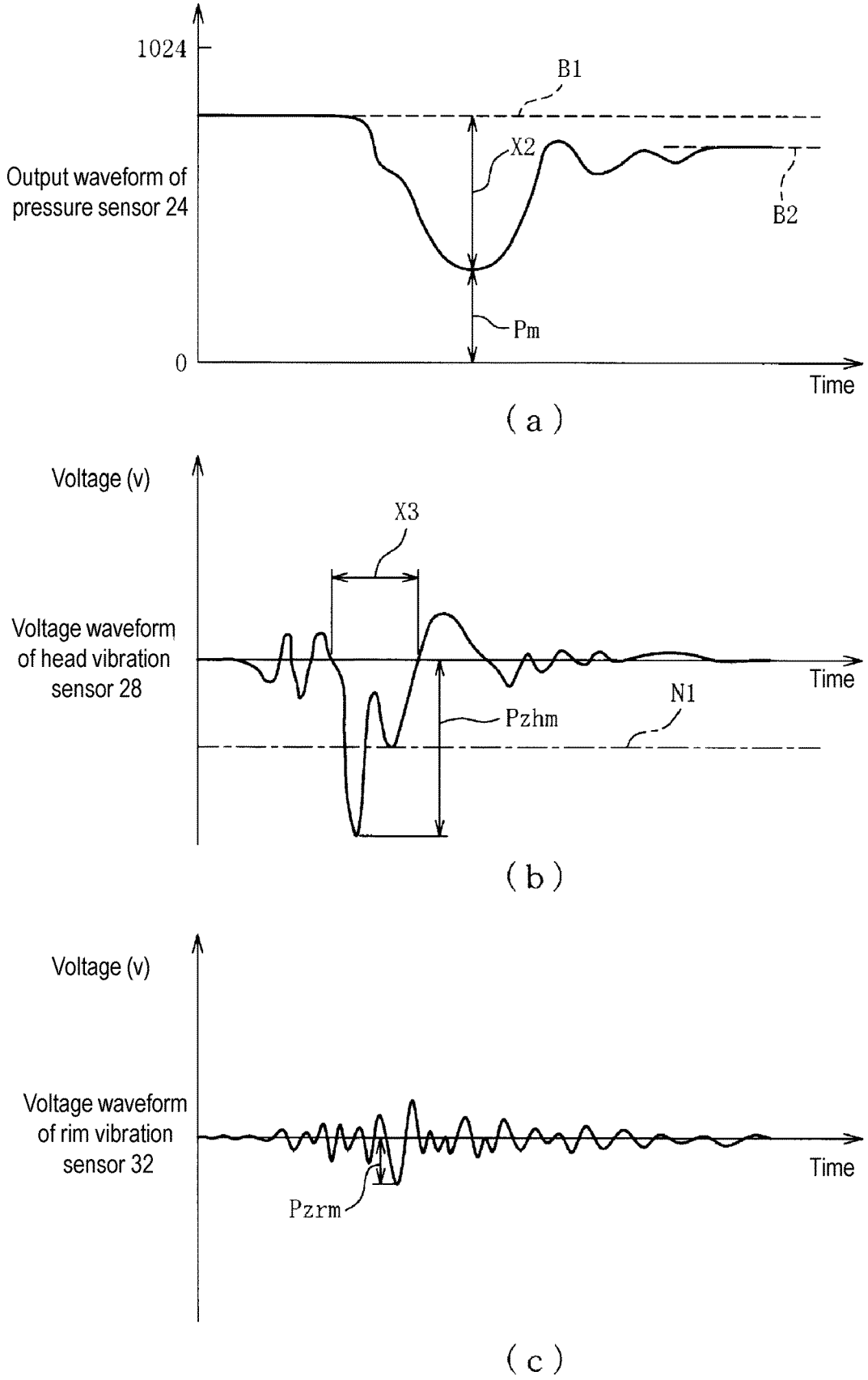

(a) of FIG. 5 is an output value-time graph of an output waveform of a pressure sensor, (b) of FIG. 5 is a voltage-time graph of a voltage waveform of a head vibration sensor, and (c) of FIG. 5 is a voltage-time graph of a voltage waveform of a rim vibration sensor.

Figure 6:
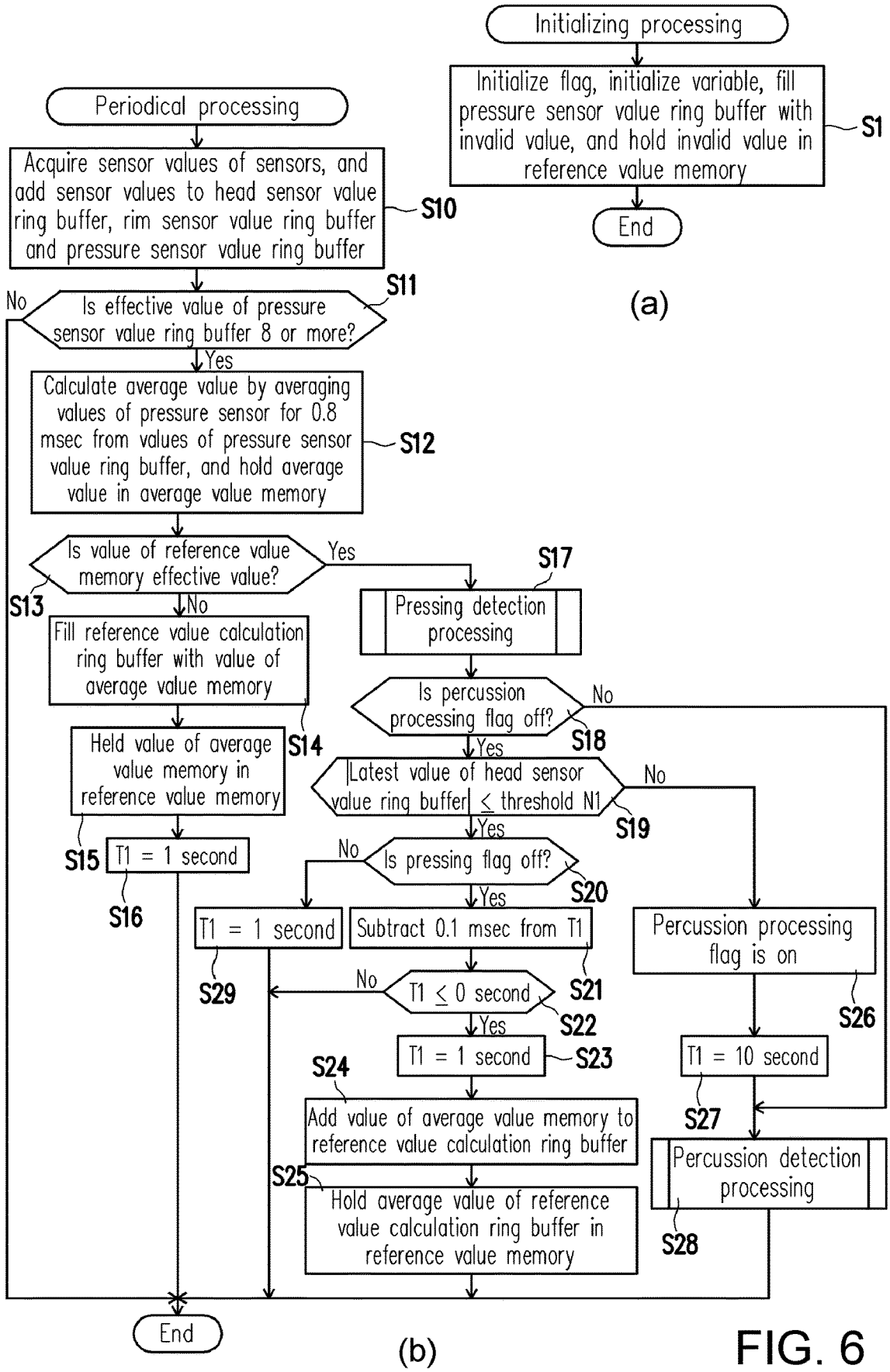

(a) of FIG. 6 is a flowchart of initialization processing, and (b) of FIG. 6 is a flowchart of periodical processing.

Figure 7:
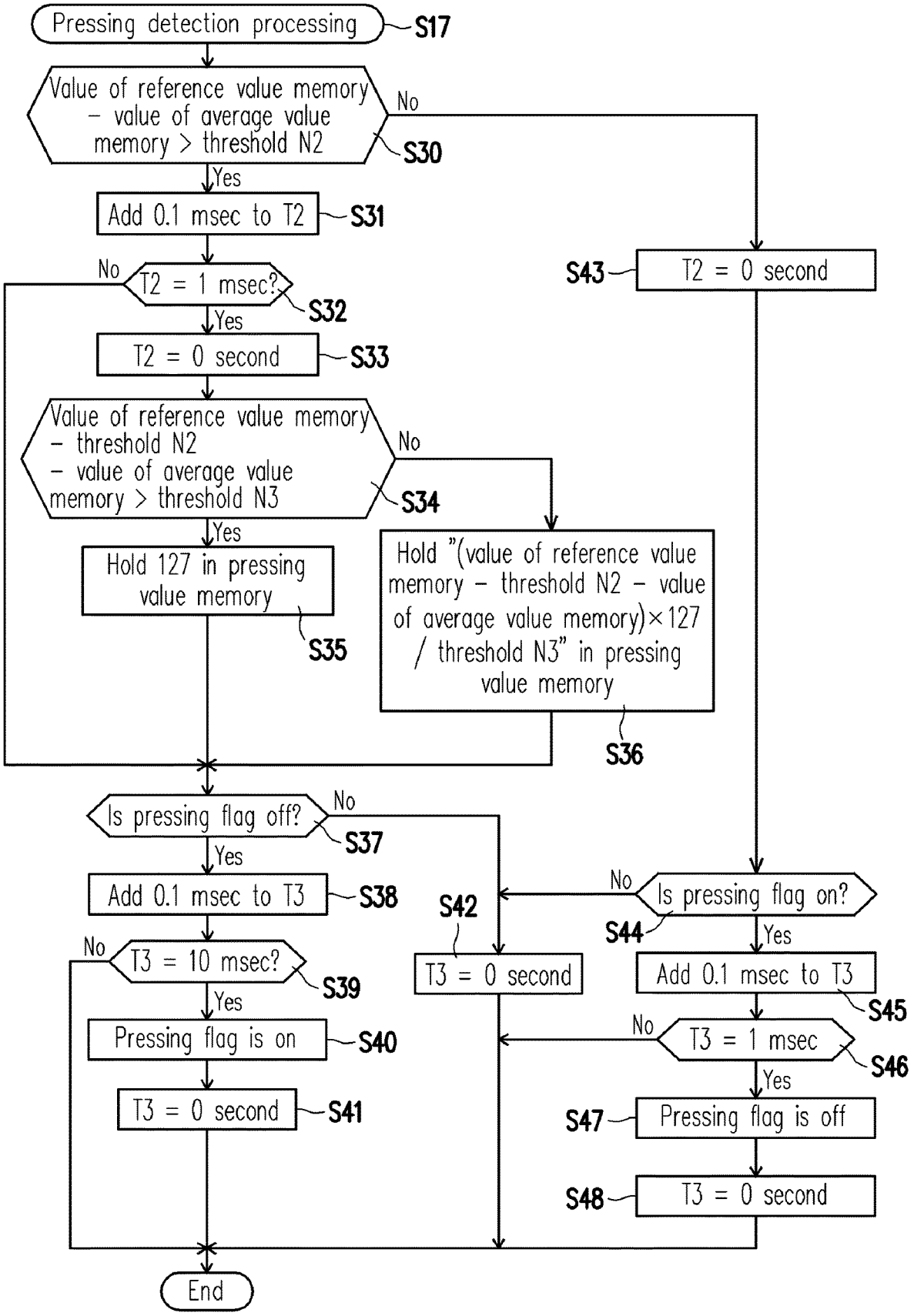

FIG. 7 is a flowchart of pressing detection processing.

Figure 8:
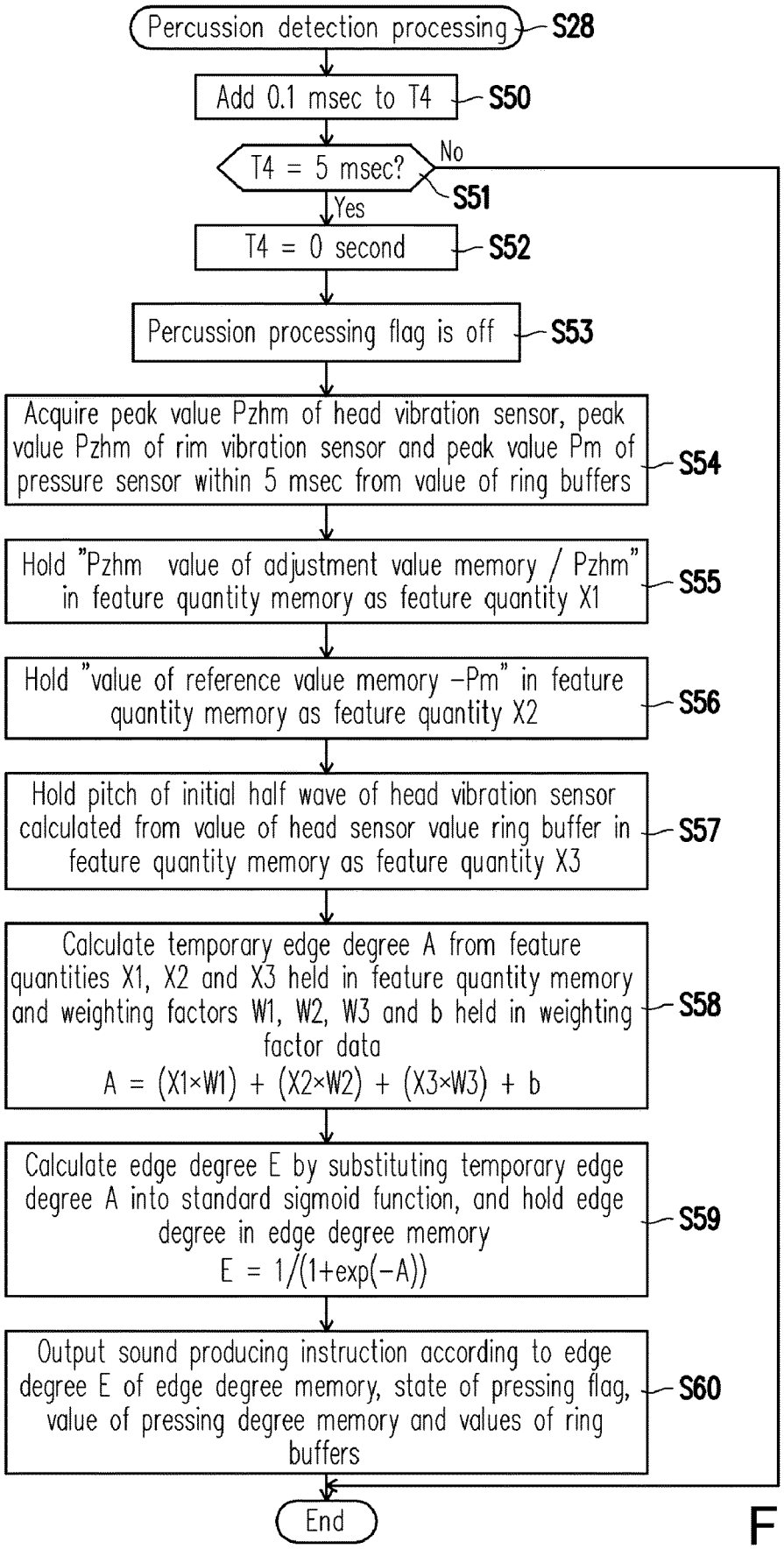

FIG. 8 is a flowchart of percussion detection processing.

Figure 9:
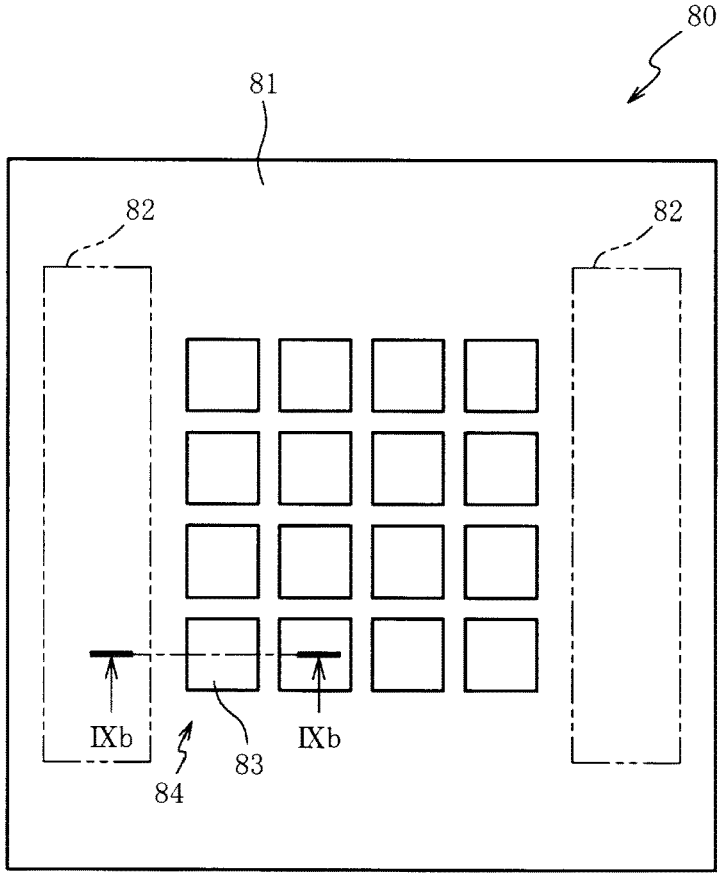
Figure 9:
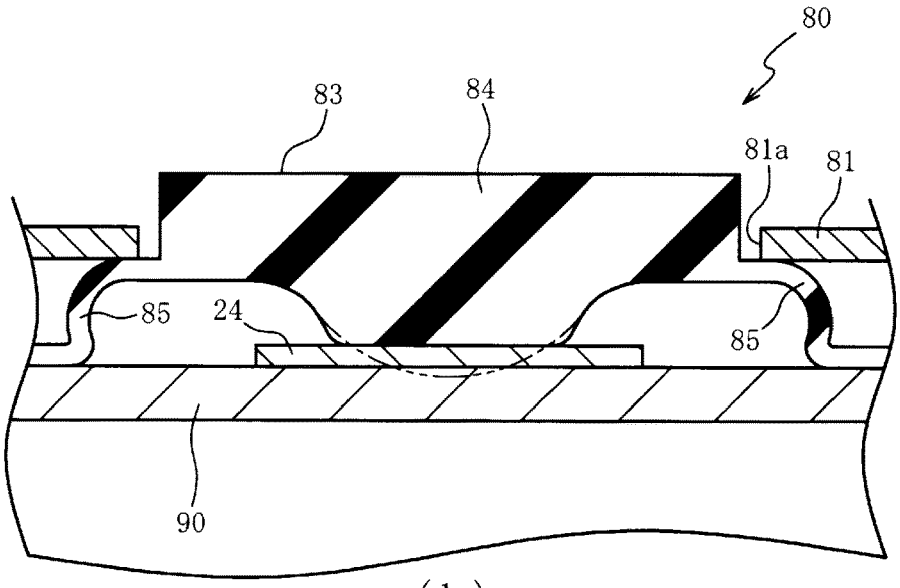

(a) of FIG. 9 is a plan view of a MIDI controller according to a second embodiment, and (b) of FIG. 9 is a cross-sectional view of the MIDI controller taken along line IXb-IXb in (a) of FIG. 9.

Figure 10:
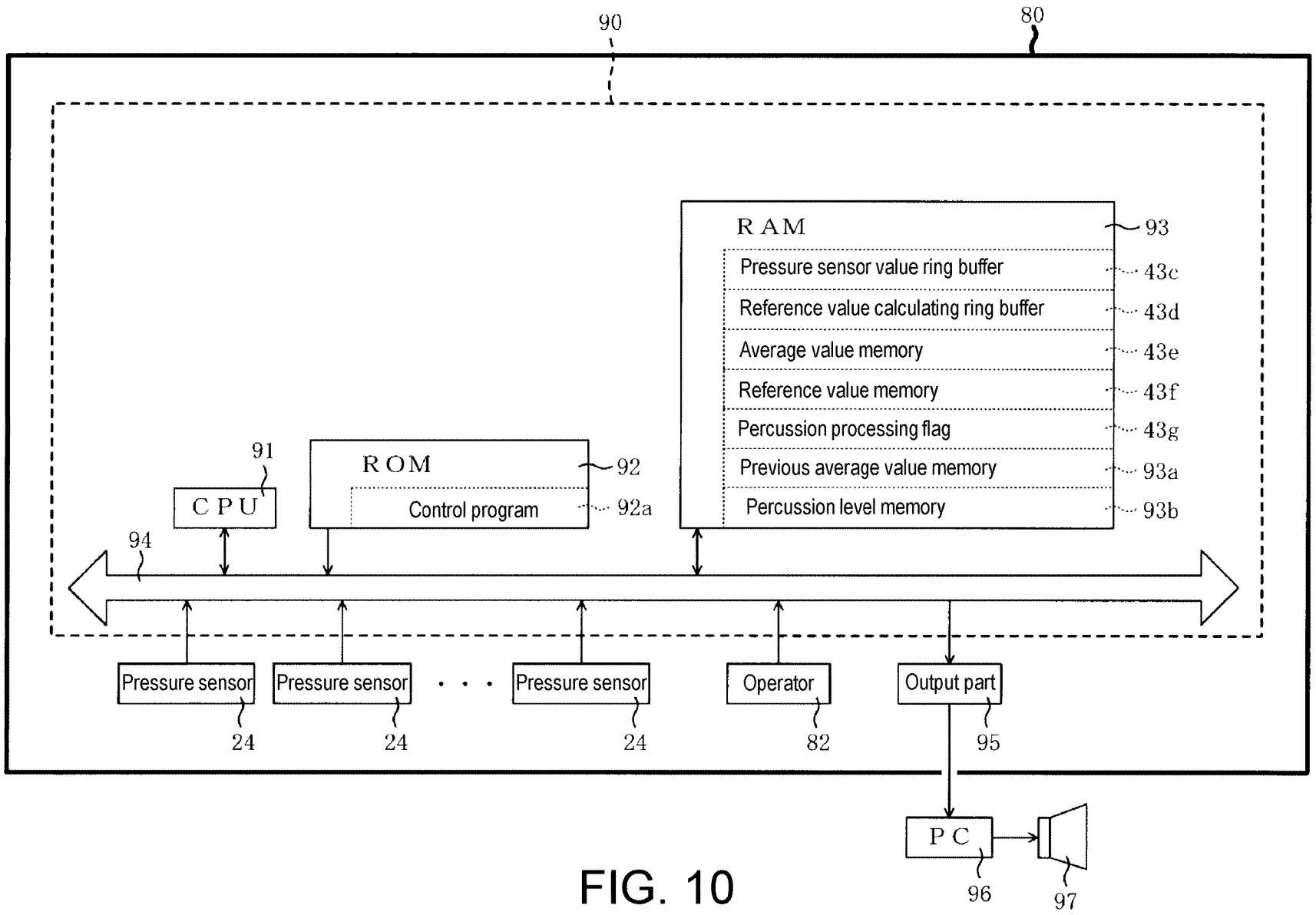

FIG. 10 is a block diagram showing an electrical configuration of the MIDI controller.

Figure 11:
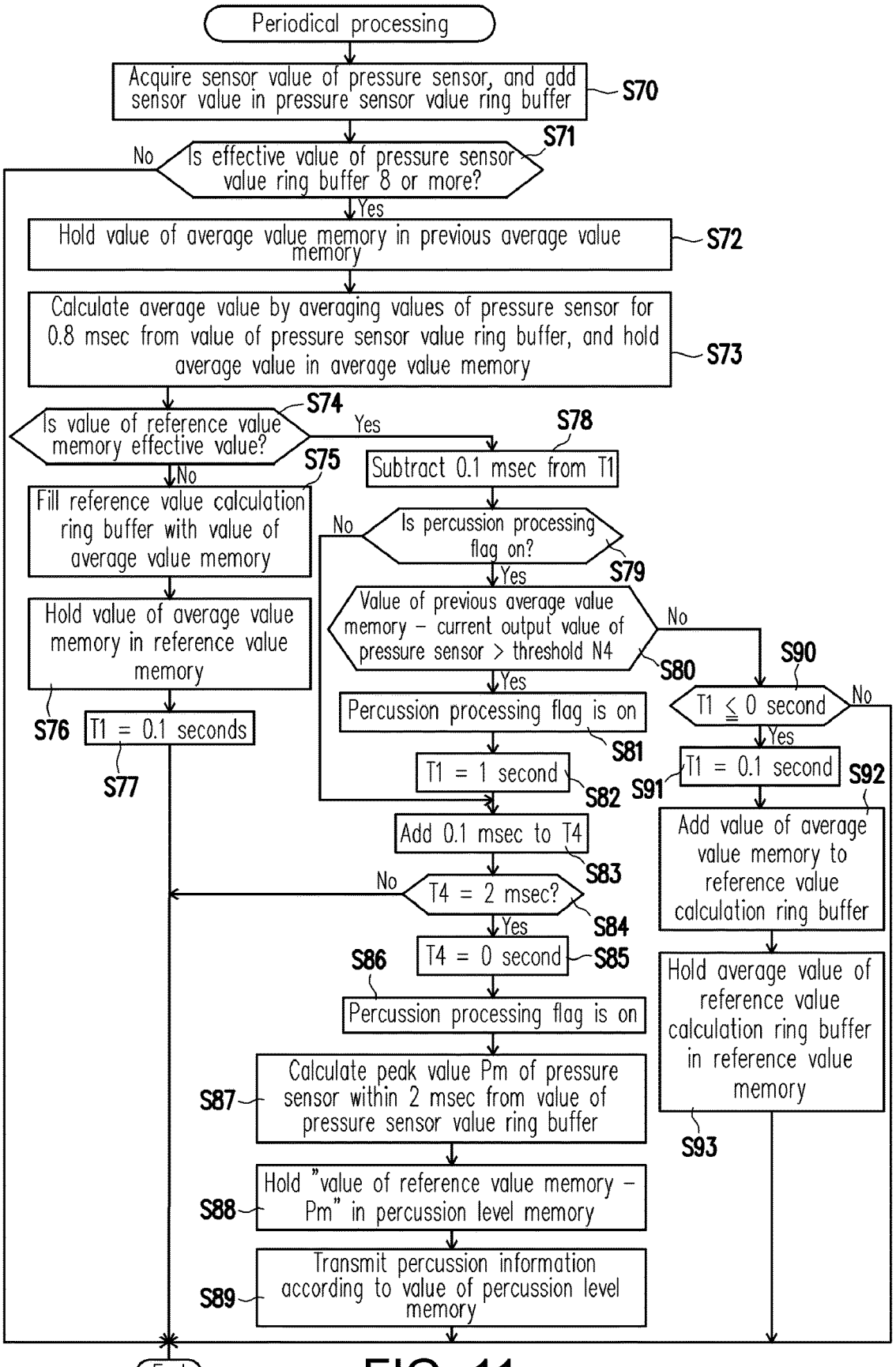

FIG. 11 is a flowchart of periodical processing.

DESCRIPTION OF THE EMBODIMENTS

Figure 1:
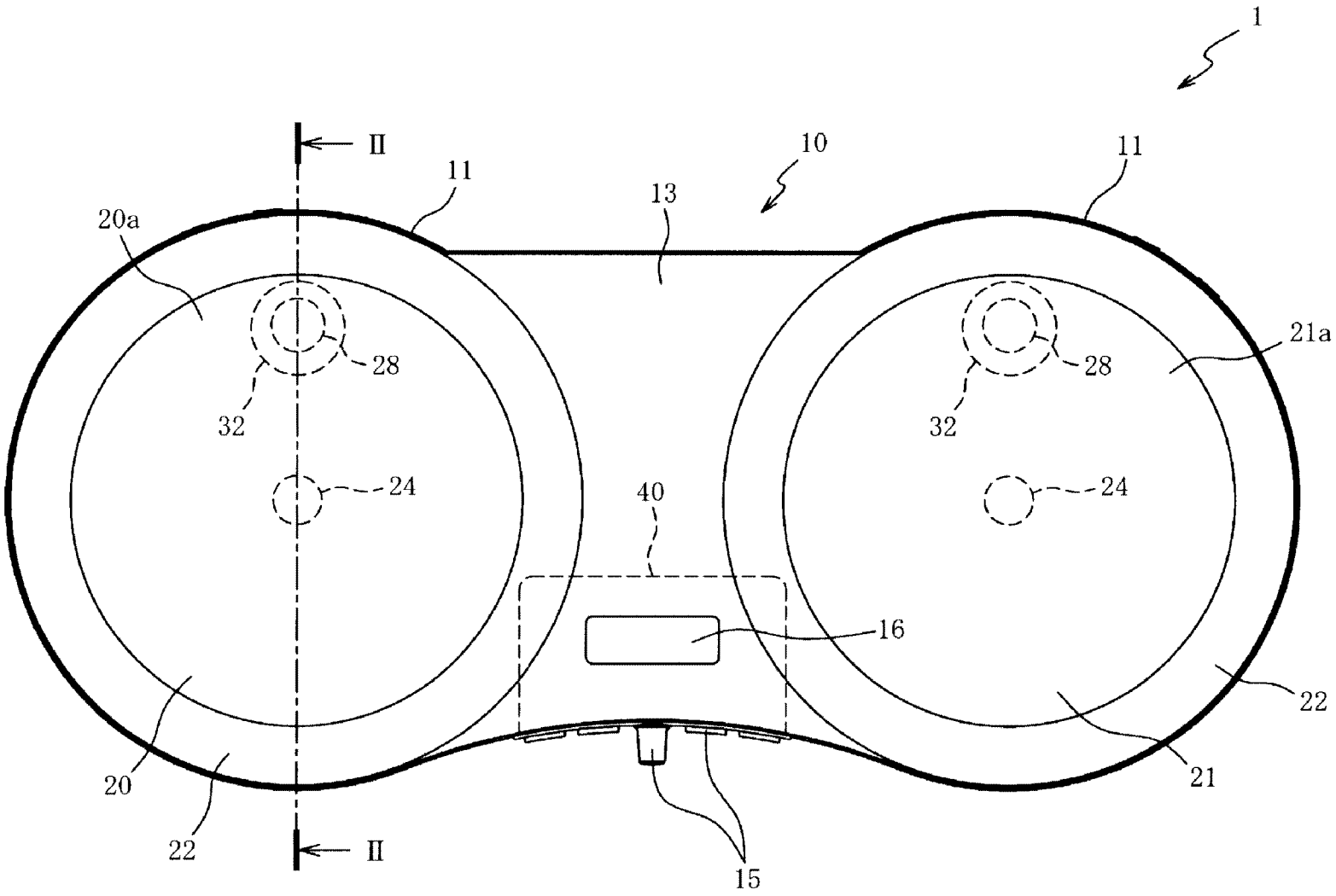
FIG. 1 is a plan view of an electronic percussion instrument according to a first embodiment.
Figure 2:
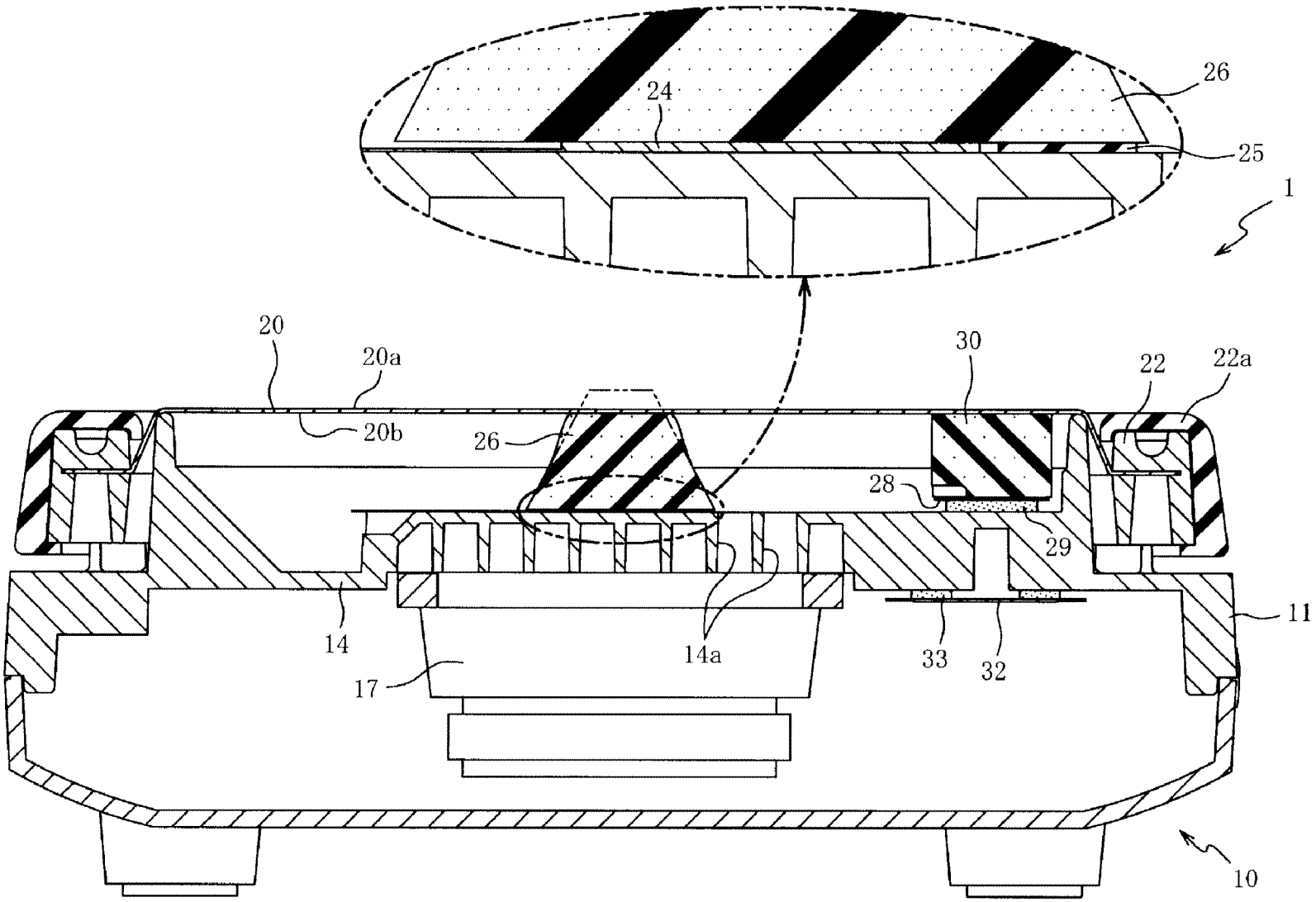
FIG. 2 is a cross-sectional view of the electronic percussion instrument taken along line II-II in FIG. 1.

Hereinafter, preferred embodiments will be described with reference to the accompanying drawings. First, the entire configuration of an electronic percussion instrument (a musical sound generating apparatus) 1 will be described with reference to FIG. 1 and FIG. 2. FIG. 1 is a plan view of the electronic percussion instrument 1 according to a first embodiment. FIG. 2 is a cross-sectional view of the electronic percussion instrument 1 taken along line II-II in FIG. 1. Further, in order to make understanding easier, a front side of the drawing of FIG. 1 and an upper side of FIG. 2 indicate an upward side of the electronic percussion instrument 1, and a rear side of the drawing of FIG. 1 and a lower side of FIG. 2 indicate a downward side of the electronic percussion instrument 1. In addition, a left side, a right side, a lower side and an upper side of the drawing of FIG. 1 indicate a leftward side, a rightward side, a forward side (on the side of a player), and a back side of the electronic percussion instrument 1, respectively.

As shown in FIG. 1 and FIG. 2, the electronic percussion instrument 1 is an electronic musical instrument that simulates a bongo that is played by a player by hitting it with the hands. The electronic percussion instrument 1 mainly includes a housing 10, two heads 20 and 21 attached to the housing 10, rims 22 provided on outer edges of the heads 20 and 21, respectively, pressure sensors 24 configured to detect pressing against the heads 20 and 21, head vibration sensors 28 configured to detect vibrations of the heads 20 and 21, rim vibration sensors 32 configured to detect vibrations of the housing 10, and a control device 40 configured to output an instruction for production of musical sound.

The electronic percussion instrument 1 is formed substantially laterally symmetrically. The head 20 is provided on the left side of the electronic percussion instrument 1, and the head 21 is provided on the right side of the electronic percussion instrument 1. The pressure sensors 24, the head vibration sensors 28 and the rim vibration sensors 32 are disposed on the heads 20 and 21, respectively. Hereinafter, the left side of the electronic percussion instrument 1 will be described and description of the right side will be omitted unless the context clearly indicates otherwise.

The housing 10 includes cylindrical shells 11, a connecting part 13 configured to connect the shells 11 on both of left and right sides, and a frame 14 to which the pressure sensors 24, the head vibration sensors 28, and the like, are attached. The shells 11 are cylindrical members, lower ends of which are closed and upper ends of which are open, and formed of a synthetic resin, a metal, or the like. The connecting part 13 is formed such that the inside thereof is connected to the insides of the shells 11. The shells 11 on both of left and right sides and the connecting part 13 are formed by assembling a top case in which upper halves of the shells 11 on both of left and right sides and the connecting part 13 are formed integrally and a bottom case in which lower halves thereof are formed integrally to each other.

The control device 40 is provided in the connecting part 13. A plurality of operators 15 or a liquid crystal display (LCD) 16 electrically connected to the control device 40 are provided on the connecting part 13. The operators 15 or the LCD 16 are provided on the connecting part 13 on the side of a player. The operators 15 are configured for setting user parameters and the like used in calculation of a peak ratio feature quantity X1, which will be described below. The LCD 16 is a display device on which the user parameters and the like are displayed.

The frame 14 is a substantially disc-shaped member having an outer circumference that is formed integrally with the top case of the shell 11. The frame 14 divides the inside of the shell 11 into upper and lower parts, and vertically faces the head 20. A speaker 17 configured to produce musical sound upward is attached to a lower surface of a central section of the frame 14 in a radial direction. A plurality of through-holes 14*a* passing through in a plate thickness direction is formed in the frame 14 above the speaker 17. Accordingly, the musical sound produced upward from the speaker 17 is directed toward the head 20 through the through-holes 14*a*.

The head 20 is a membrane member configured to cover an upper end of the shell 11, and formed of a mesh-shaped element. Accordingly, the musical sound produced from the speaker 17 and passing through the through-holes 14*a* is emitted outside of the electronic percussion instrument 1 from the head 20. A percussion surface 20*a* that is a surface (an upper surface) of the head 20 is percussed with the hands or the like of a player. A back surface 20*b* of the head 20 faces the frame 14. Further, a surface of the head 21 configured to cover an upper end of the shell 11 on the left side is a percussion surface 21*a*.

The rim 22 is an annular member to which an outer edge of the head 20 is fixed throughout the entire circumference. The head 20 to which tension is applied is attached to the housing 10 by fixing the rim 22 to an outer side of an upper end portion of the shell 11. A cover 22*a* formed of rubber is provided on an upper surface and an outer circumferential surface of the rim 22. Accordingly, a burden on a hand when the rim 22 is percussed with the hands can be minimized.

The pressure sensors 24 are a disc-shaped pressure-sensitive resistor element configured to detect a pressure change. A circuit is configured such that an output value of the pressure sensor 24 is a maximum in a state in which a pressure is not applied to the pressure sensor 24. As the pressure applied to the pressure sensor 24 is increased, an output value of the pressure sensor 24 is reduced. The pressure sensor 24 is attached to an upper surface of the frame 14 and disposed on a central section of the head 20 (the percussion surface 20*a*) on the side of the back surface 20*b*. Further, when a center of the percussion surface 20*a* in the radial direction is taken as 0% and an inner circumferential edge of the rim 22 is 100%, the central section of the percussion surface 20*a* is preferably an area within 10%. Further, the pressure sensor 24 is preferably disposed at the center of the percussion surface 20*a* in the radial direction.

A spacer 25 is provided around the pressure sensor 24 except at a portion through which a wiring (not shown) that connects the pressure sensor 24 and the control device 40 passes. The spacer 25 is a plate-shaped member that is slightly thicker than the pressure sensor 24, and attached to an upper surface of the frame 14.

An elastic body 26 is attached to an upper surface of the spacer 25. The elastic body 26 is a quadrangular pyramidal buffer material formed of sponge, and covers the pressure sensor 24 from above. FIG. 2 shows the elastic body 26 in a state in which a load is not applied using a two-dot dashed line. In the elastic body 26, a vertical dimension (a dimension of the shell 11 in an axial direction) in a state in which a load is not applied is set to be greater than a vertical dimension between the head 20 and the pressure sensor 24 that are attached to the housing 10. Accordingly, the elastic body 26 is compressed between the head 20 (the percussion surface 20*a*) and the pressure sensor 24 in an upward/downward direction.

When the percussion surface 20*a* is percussed or pressed, the pressure sensor 24 is pressed through the elastic body 26, and the percussion or the pressing is detected by the pressure sensor 24. Since the spacer 25 is provided around the pressure sensor 24, as the percussion surface 20*a* is pressed, a contact area between the pressure sensor 24 and the elastic body 26 can be increased from a center of the pressure sensor 24 to the spacer 25. Accordingly, an output value of the pressure sensor 24 can be easily changed according to a pressing amount or an intensity of percussion on the percussion surface 20*a*. Further, since the elastic body 26 is formed in a quadrangular pyramid shape that becomes thinner toward the percussion surface 20*a*, the pressure from the percussion surface 20*a* can be stably applied to the pressure sensor 24.

In addition, even when the percussion surface 20*a* is not being pressed or percussed, since the elastic body 26 is compressed between the percussion surface 20*a* and the pressure sensor 24, there is no gap between the percussion surface 20*a* and the pressure sensor 24. For this reason, even when the percussion surface 20*a* is not strongly pressed, an output value of the pressure sensor 24 can be changed. Accordingly, the sensitivity of the pressure sensor 24 with respect to the percussion or the pressing against the percussion surface 20*a* can be improved.

The head vibration sensor 28 is formed of a disc-shaped piezoelectric element configured to detect vibrations. The head vibration sensor 28 is disposed on the side of the back surface 20*b* of the head 20, and attached to an upper surface of the frame 14 with double sided tape 29 sandwiched therebetween. The head vibration sensor 28 is disposed on a peripheral section of the head 20 (the percussion surface 20*a*) on the side of the back surface separated from a player. Further, the peripheral section is preferably an area of 70% or more when a center of the head 20 in the radial direction is taken as 0%, and an inner circumferential edge of the rim 22 is 100%.

The double sided tape 29 is a disc-shaped member having cushioning properties. A diameter of the double sided tape 29 is smaller than a diameter of the head vibration sensor 28. Accordingly, an outer circumferential side of the head vibration sensor 28 can be easily deformed, and detection sensitivity for the head vibration sensor 28 can be secured.

A cushion 30 is adhered to an upper surface of the head vibration sensor 28 (on the side of the head 20). The cushion 30 is a columnar buffer material formed of sponge, and covers the head vibration sensor 28 from above.

In the cushion 30, a vertical dimension in a state in which a load is not applied is set to be greater than a vertical dimension between the head 20 and the head vibration sensor 28 that are attached to the housing 10. Accordingly, the elastic body 26 is compressed between the head 20 (the percussion surface 20*a*) and the head vibration sensor 28 in the upward/downward direction. For this reason, a contact state between the head 20 and the cushion 30 that are vibrated due to percussion can be maintained, and vibrations of a peripheral section of the head 20 (the percussion surface 20*a*) can be reliably detected by the head vibration sensor 28. Further, in the electronic percussion instrument 1 according to the embodiment, it is determined that percussion on the percussion surface 20*a* is detected by the head vibration sensor (a percussion detection unit) 28 and the percussion surface 20*a* is percussed according to an output value of the head vibration sensor 28.

When the percussion surface 20*a* directly above the head vibration sensor 28 is percussed, the output value of the head vibration sensor 28 may easily abruptly increase in contrast to the case in which the other position of the percussion surface 20*a* is percussed. Since a side of the back surface of the head 20 on which the head vibration sensor 28 is disposed and which is far from a player is at a position that cannot be easily directly percussed by the player, it is possible to prevent the output value of the head vibration sensor 28 from abruptly increasing. In particular, in the electronic percussion instrument 1 of the embodiment, since the two percussion surfaces 20*a* and 21*a* are provided in the housing 10 and the operators 15 or the LCD 16 are disposed on the housing 10 on the front side, the operators 15 or the LCD 16 can be disposed on the side of the player and the head vibration sensor 28 can be reliably disposed on the side of the back surface. As a result, it is unlikely that the output value of the head vibration sensor 28 will abruptly increase.

The rim vibration sensor 32 is formed of a disc-shaped piezoelectric element configured to detect vibrations. The rim vibration sensor 32 is disposed at a position overlapping the head vibration sensor 28 when seen in a plan view (FIG. 1) of the percussion surface 20*a*. The rim vibration sensor 32 is attached to a lower surface of the frame 14 with double sided tape 33 sandwiched therebetween.

The double sided tape 33 is an annular-plate-shaped member having cushioning properties. Accordingly, a central part of the rim vibration sensor 32 can be easily deformed, and detection sensitivity for the rim vibration sensor 32 can be secured. An outer diameter of the double sided tape 33 is smaller than a diameter of the rim vibration sensor 32. Accordingly, an outer circumferential side of the rim vibration sensor 32 can be easily deformed, and detection sensitivity of the rim vibration sensor 32 can be secured.

The control device 40 is disposed in the housing 10. The control device 40 outputs sound producing instructions according to output values of the pressure sensors 24, the head vibration sensors 28 and the rim vibration sensors 32 provided on the percussion surfaces 20*a* and 21*a*, respectively, to a sound source 45 (see FIG. 3). The control device 40 is connected to the pressure sensors 24, the head vibration sensors 28, the rim vibration sensors 32, and the like, by wiring (not shown).

Figure 3:
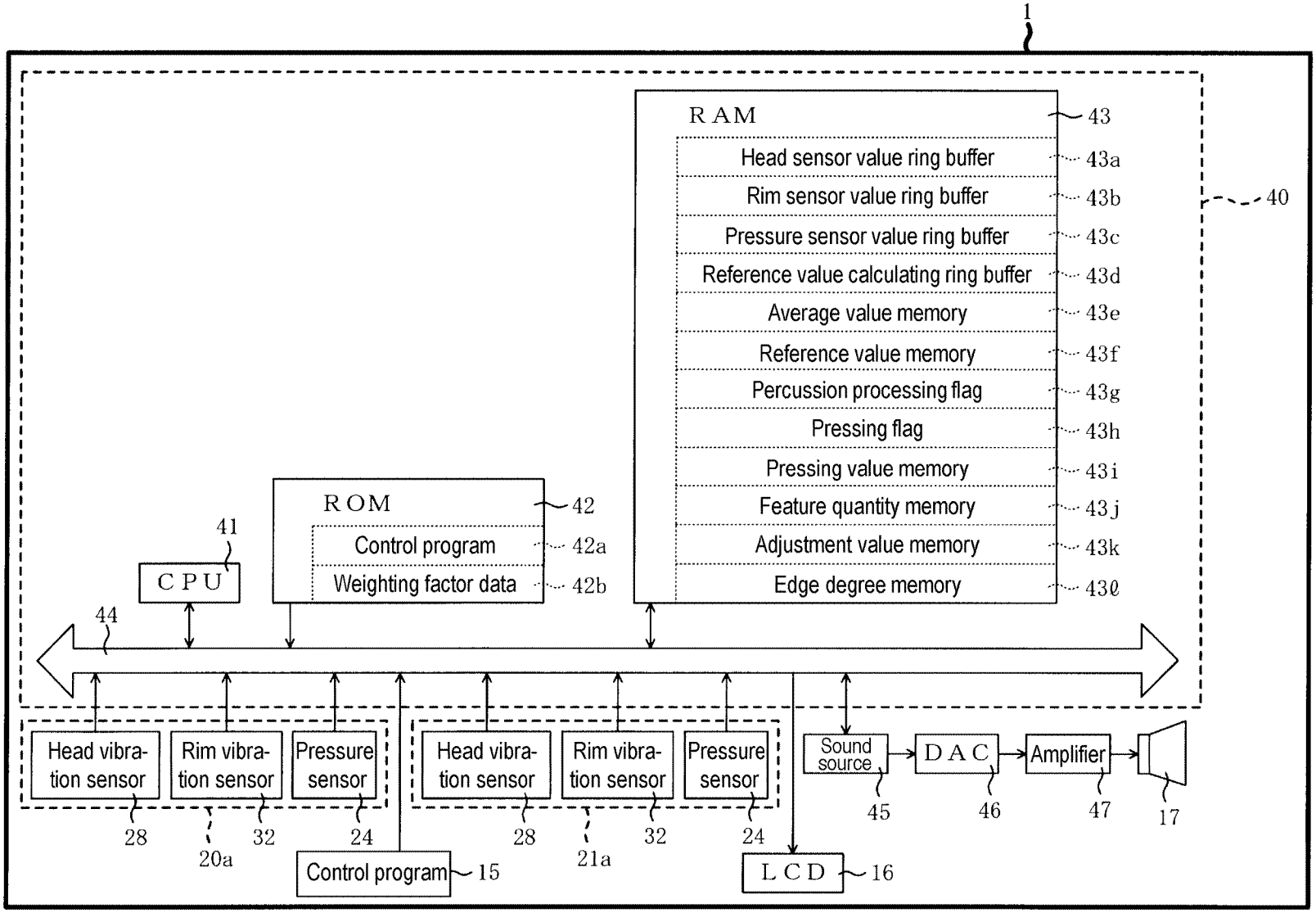
FIG. 3 is a block diagram showing an electrical configuration of the electronic percussion instrument.

Next, an electrical configuration of the electronic percussion instrument 1 will be described with reference to FIG. 3. FIG. 3 is a block diagram showing the electrical configuration of the electronic percussion instrument 1. The control device 40 of the electronic percussion instrument 1 has a CPU 41, a ROM 42 and a RAM 43, which are connected to each other by bus lines 44. In addition, the pressure sensor 24, the head vibration sensor 28 and the rim vibration sensor 32 that are on the side of the percussion surface 20*a*, the pressure sensor 24, the head vibration sensor 28 and the rim vibration sensor 32 that are on the side of the percussion surface 21*a*, the operators 15, the LCD 16 and the sound source 45 are respectively connected to the bus lines 44. A DAC 46 is connected to the sound source 45, an amplifier 47 is connected to the DAC 46, and the speaker 17 is connected to the amplifier 47.

The electronic percussion instrument 1 outputs sound producing instructions according to detection results (output values) of the pressure sensors 24, the head vibration sensors 28 and the rim vibration sensors 32 on the basis of the percussion when the percussion surfaces 20*a* and 21*a* are percussed with the hands from the CPU 41 to the sound source 45. The sound source 45 is an apparatus for controlling tone colors, various effects, and the like, of musical sound (percussion sound) according to the sound producing instructions from the CPU 41. While not shown, a filter for waveform data or a digital signal processor (DSP) configured to perform arithmetic processing such as for effects are built into the sound source 45. The electronic percussion instrument 1 converts a digital musical sound signal processed by the sound source 45 into an analog signal using the DAC 46, amplifies the signal using the amplifier 47, and emits musical sound from the speaker 17 on the basis of the musical sound signal.

The electronic percussion instrument 1 can generate a sound producing instruction or a musical sound signal such that musical sound according to the percussion on the percussion surface 20*a* and musical sound according to the percussion on the percussion surface 21*a* are different from each other because the two percussion surfaces 20*a* and 21*a* are provided in the housing 10. Accordingly, the electronic percussion instrument 1 can simulate rendition of an acoustic bongo having different tone colors on the percussion surfaces 20*a* and 21*a*.

The CPU 41 is an arithmetic operation apparatus for controlling the respective parts connected by the bus lines 44. The ROM 42 is a non-rewritable memory. A control program 42*a* and weighting factor data 42*b* are stored (held) in the ROM 42. When the control program 42*a* is executed by the CPU 41, initialization processing ((a) of FIG. 6) is executed immediately after input of electric power to the electronic percussion instrument 1, and then, periodical processing is executed.

In addition, while not shown, a crosstalk cancellation program (a crosstalk cancellation means) is provided in the control program 42*a*. Crosstalk means, for example, vibrations due to percussion being transmitted toward the percussion surface 21*a* when the percussion surface 20*a* is percussed. Crosstalk cancellation is processing such that musical sound is not produced on the basis of vibrations of the percussion surface 21*a* even when vibrations of the percussion surface 21*a* due to crosstalk are detected by the head vibration sensors 28. A known crosstalk cancellation program can be optimized and used in the embodiment as long as the program is a program that can execute crosstalk cancellation.

A crosstalk cancellation program will be described with reference to FIG. 4. In the following description, while the case in which the percussion surface 20*a* is percussed and the percussion surface 21*a* receives crosstalk will be described, this is also the same as in the case in which the percussion surface 21*a* is percussed and the percussion surface 20*a* receives crosstalk. In addition, when an output value of the head vibration sensor 28 of the percussion surface 20*a* (the latest value of a head sensor value ring buffer 43*a*) exceeds a percussion threshold N1 (see (b) of FIG. 5), which will be described below, a trigger signal from the percussion surface 20*a* is referred to as being output, and a peak value of the head vibration sensor 28 of the percussion surface 20*a* at this time is referred to as a level of a trigger signal. This is also the same as in the output value of the head vibration sensor 28 of the percussion surface 21*a*.

As shown in FIG. 4, an envelope 71 for calculating a crosstalk amount and an envelope 72 for cancelling out crosstalk are used in crosstalk cancellation. (a) of FIG. 4 is a schematic view showing shapes of the envelope 71 for calculating a crosstalk amount and the envelope 72 for cancelling out crosstalk. Further, in (a) of FIG. 4, a horizontal axis shows a time, and a vertical axis shows a level.

The envelope 71 for calculating a crosstalk amount is an envelope for calculating a value showing a degree of crosstalk (i.e., a crosstalk amount) received from the percussion surface 20*a* by the percussion surface 21*a*. Meanwhile, the envelope 72 for cancelling out crosstalk is an envelope used for determining whether crosstalk cancellation will be executed with respect to a trigger signal input from the percussion surfaces 20*a* and 21*a*.

Each of the envelope 71 for calculating a crosstalk amount and the envelope 72 for cancelling out crosstalk is a virtual envelope that simulates vibration states of the percussion surfaces 20*a* and 21*a* from which a trigger signal which is generated is output, and as shown in (a) of FIG. 4, generated on the basis of the level of the trigger signal which is generated. Specifically, the envelopes 71 and 72 are expressed by a linear function in which a level L of a trigger signal at a time t1 becomes zero at a time t2 after a fixed time (in the embodiment, 200 milliseconds) when the trigger signal that is a generating target is generated at the time t1. That is, in each of the envelope 71 for calculating a crosstalk amount and the envelope 72 for cancelling out crosstalk, the rate of reduction increases as the level of the trigger signal which is generated increases.

The trigger signal that is a generating target is a trigger signal from the percussion surface 20*a* determined as being percussed in the envelope 71 for calculating a crosstalk amount. That is, only one envelope 71 for calculating a crosstalk amount is generated for the percussion surface 20*a* determined as having been percussed.

Meanwhile, in the envelope 72 for cancelling out crosstalk, the trigger signal that is a generating target is a trigger signal from the percussion surface 20*a* determined as being percussed or a trigger signal from the percussion surface 21*a* determined as producing sound due to the crosstalk received from the percussion surface 20*a*. That is, only one or a plurality of envelopes 72 for cancelling out crosstalk are generated with respect to the percussion surface 20*a* determined as having been percussed and the percussion surface 21*a* that has received crosstalk or generated sound. Further, the envelope 72 for cancelling out crosstalk generated on the percussion surface 20*a* determined as being percussed is an envelope having the same shape as that of the envelope 71 for calculating a crosstalk amount.

(b) of FIG. 4 is a view for describing a method of calculating a crosstalk amount used in the envelope 71 for calculating a crosstalk amount. The crosstalk amount is calculated as a ratio between a current value of the envelope 71 for calculating a crosstalk amount and a trigger signal that was input as long as the envelope 71 for calculating a crosstalk amount is already generated on the percussion surface 20*a* when the trigger signal is input from the percussion surface 21*a*.

Specifically, provided that a level of a trigger signal input from the percussion surface 21*a* at a time x1 is y1*b* and a current value at a time x1 in the envelope 71 for calculating a crosstalk amount generated on the percussion surface 20*a* is y1*a*, a crosstalk amount (%) received by the percussion surface 21*a* is calculated as $(y1b/y1a)\times 100$.

(c) of FIG. 4 is a view for describing a method of determining crosstalk cancellation performed using the envelope 72 for cancelling out crosstalk. Determination of whether crosstalk cancellation is performed with respect to the trigger signal from the percussion surface 20*a* or the percussion surface 21*a* is performed using the envelope 72 in which the current value of the envelope 72 for cancelling out crosstalk that is generated is a maximum at a time when the trigger signal that is a determination target is input. More specifically, determination of whether crosstalk cancellation will be performed is performed by comparison between a level of crosstalk cancellation obtained by multiplying a cancellation rate defined on the percussion surface 20*a* or the percussion surface 21*a* of an output origin of a trigger signal that is a determination target by the current value in the envelope 72 for cancelling out crosstalk used for determination (i.e., a time when the trigger signal that is a determination target is input) and a level of a trigger signal that is a determination target. When the former is larger than the latter, it is determined that crosstalk cancellation is executed with respect to the trigger signal that is a determination target. Meanwhile, when the former is smaller than the latter, it is determined that crosstalk cancellation is not executed with respect to the trigger signal that is a determination target.

"The cancellation rate" is a value obtained by dividing a crosstalk cancellation setting value set with respect to each of the percussion surfaces 20*a* and 21*a* by 100. That is, provided that the crosstalk cancellation setting value is A, the cancellation rate is expressed as A/100. When determination of whether crosstalk cancellation is performed is performed, a crosstalk cancellation setting value set with respect to the percussion surfaces 20*a* and 21*a* of the output origin of the trigger signal that is a determination target is used as the value A (the crosstalk cancellation setting value).

Further, execution of crosstalk cancellation becomes more difficult as the crosstalk cancellation setting value increases. An initial value of the crosstalk cancellation setting value is stored in an area (not shown) of a flash memory (not shown) or the ROM 42 upon shipment of products. The crosstalk cancellation setting value in the flash memory is configured to be able to be changed for each of the percussion surfaces 20*a* and 21*a* according to needs of a user.

In the method of determining crosstalk cancellation, specifically, in the envelope 72 for cancelling out crosstalk generated solely or in plural, when a maximum value of the current value at a time x2 that the trigger signal is input from the percussion surface 20*a* or the percussion surface 21*a* is set as y2, a level of the input trigger signal is compared with y2×(A/100) that is a level for crosstalk cancellation. (A/100) is a cancellation rate defined with respect to the percussion surface 20*a* or the percussion surface 21*a* of the output origin of the trigger signal. In this case, for example, it is determined that crosstalk cancellation with respect to the trigger signal is executed when a level of the trigger signal input from the percussion surface 20*a* or the percussion surface 21*a* (the trigger signal of the determination target) is L2 smaller than y2×(A/100). Meanwhile, when the level of the trigger signal of the determination target is L1 greater than y2×(A/100), it is determined that crosstalk cancellation is not executed with respect to the trigger signal, i.e., the trigger signal of the sound producing target.

In this way, in the crosstalk cancellation program of the control device 40, for example, by comparing the output value of the head vibration sensor 28 configured to detect vibrations of the percussion surface 21*a* that is one of the two percussion surfaces 20*a* and 21*a* with the output value of the head vibration sensor 28 configured to detect vibrations of the percussion surface 20*a* that is the other, when it is determined that the vibrations generated on the percussion surface 21*a* are caused by the crosstalk generated on the basis of the vibrations of the other percussion surface 20*a*, the sound producing instruction based on the vibrations due to the crosstalk is not output. Accordingly, as the percussion surface 20*a* is percussed, even when the vibrations of the percussion surface 21*a* that is not percussed are detected by the head vibration sensor 28 of the percussion surface 21*a*, musical sound according to the detection can be prevented from being produced.

In addition, for example, when the percussion position on the percussion surface 20*a* is calculated according to the output value of the head vibration sensor 28 on the side of the percussion surface 20*a*, by comparing the output value of the head vibration sensor 28 on the side of the percussion surface 20*a* with the output value of the head vibration sensor 28 on the side of the percussion surface 21*a*, a vibration element of the percussion surface 20*a* due to the crosstalk generated based on the vibrations of the percussion surface 21*a* may be removed according to the crosstalk amount. Accordingly, calculation accuracy of the percussion position on the percussion surface 20*a* can be improved.

Further, similarly, by comparing the output value of the rim vibration sensor 32 on the side of the percussion surface 20*a* with the output value of the rim vibration sensor 32 on the side of the percussion surface 21*a*, in the output value of the rim vibration sensor 32 on the side of the percussion surface 20*a*, an element due to the crosstalk generated on the basis of the vibrations of the percussion surface 21*a* may be calculated. When the percussion position on the percussion surface 20*a* is calculated according to the output value of the rim vibration sensor 32 on the side of the percussion surface 20*a*, calculation accuracy of the percussion position on the percussion surface 20*a* can be improved by removing the element of the output value of the rim vibration sensor 32 on the side of the percussion surface 20*a* due to the crosstalk generated on the basis of the vibrations of the percussion surface 21*a* according to the crosstalk amount.

Explanation will be continued by returning to FIG. 3. When the control device 40 has various data, a memory or a flag on each of the percussion surfaces 20*a* and 21*a* and periodical processing of the control program 42*a* is performed on each of the percussion surfaces 20*a* and 21*a*, data, processing, or the like, on each of the percussion surfaces 20*a* and 21*a* is the same as above. Hereinafter, data, processing, or the like, related to the percussion surface 20*a* will be described, and data, processing, or the like, related to the percussion surface 21*a* will be omitted.

In order to detect the percussion position in the percussion detection processing of FIG. 8, weighting factors W1, W2, W3 and b are held in the weighting factor data 42*b* stored in the ROM 42. The weighting factors W1, W2, W3 and b are coefficients showing importance of feature quantities X1, X2 and X3 varying according to the percussion position on the percussion surface 20*a*. In the percussion detection processing, a product of the feature quantities X1, X2 and X3 and the weighting factors W1, W2 and W3 that correspond to each other, and the weighting factor b that is a constant term are added together to calculate a temporary edge degree A. That is, the temporary edge degree A is expressed as an equation of "A=W1×X1+W2×X2+W3×X3+b."

An edge degree E expressed from 0 to 1 is calculated by substituting the temporary edge degree A into a standard sigmoid function. That is, when an exponential function with a Napier's constant as a base and ×as a variable is expressed as exp (x), the edge degree E is expressed by an equation of "E=1/(1+exp (−A))." The edge degree E is a value that is set to 0 when the center of the percussion surface 20*a* in the radial direction is percussed and 1 when an outermost side of the percussion surface 20*a* in the radial direction is percussed.

The weighting factors W1, W2, W3 and b used for calculation of the edge degree E are calculated by supervised learning of machine learning on every design of a product of the electronic percussion instrument 1, and stored in the weighting factor data 42*b* as fixed values upon shipment of the product. As a method of specific machine learning, first, a plurality of pieces of data of the feature quantities X1, X2 and X3 when the vicinity of the center of the percussion surface 20*a* in the radial direction (a range of 30% or less from the center in the radial direction) is percussed is acquired, and the edge degree E to be output when this data is input becomes 0. In addition, a plurality of pieces of data of the feature quantities X1, X2 and X3 when the vicinity of the outermost side of the percussion surface 20*a* in the radial direction (a range of 80% or more from the center in the radial direction) is percussed is acquired, and the edge degree E to be output when this data is input becomes 1. The weighting factors W1, W2, W3 and b are calculated by executing machine learning using this input/output data.

The feature quantities X1, X2 and X3 will be described with reference to FIG. 5. (a) of FIG. 5 is an output value-time graph of an output waveform of the pressure sensor 24. A vertical axis shows an output value of the pressure sensor 24 and a horizontal axis shows a time. Further, as the pressure applied to the pressure sensor 24 is increased, the output value of the pressure sensor 24 is reduced. In the embodiment, a maximum value of the output value of the pressure sensor 24 is 1024.

In a state in which the percussion surface 20*a* is not percussed or pressed, since the pressure is applied to the pressure sensor 24 from the compressed elastic body 26, the output value of the pressure sensor 24 is provided in the vicinity of a reference value B1 at a position lower than the maximum value of 1024. When the percussion surface 20*a* is percussed or pressed, the output value of the pressure sensor 24 is lowered and a peak value Pm is taken. A numerical value obtained by subtracting the peak value Pm from the reference value B1 before the percussion surface 20*a* is percussed or pressed is a pressure-sensitive peak feature quantity X2.

The pressure-sensitive peak feature quantity X2 is increased as the percussion position on the percussion surface 20*a* approaches the central section of percussion surface 20*a*, and decreased as the percussion position approaches the peripheral section of the percussion surface 20*a*. This is because the percussion surface 20*a* is easily bent downward and the pressure applied to the pressure sensor 24 from the percussion surface 20*a* is increased as the percussion position approaches the central section of the percussion surface 20*a*.

(b) of FIG. 5 is a voltage-time graph of a voltage waveform of the head vibration sensor 28. (c) of FIG. 5 is a voltage-time graph of a voltage waveform of the rim vibration sensor 32. In either (b) of FIG. 5 or (c) of FIG. 5, a vertical axis shows a voltage and a horizontal axis shows a time. The voltage waveform of the head vibration sensor 28 takes a negative voltage value (output value) when the percussion surface 20*a* is vibrated downward (toward the head vibration sensor 28). When the oscillation of the percussion surface 20*a* is large, an amplitude of the voltage waveform of the head vibration sensor 28 is increased. In addition, as the oscillation of the housing 10 is increased, the amplitude of the voltage waveform of the rim vibration sensor 32 is increased.

When an absolute value of the voltage value of the head vibration sensor 28 exceeds the predetermined percussion threshold N1, the CPU 41 determines that the percussion surface 20*a* is percussed. A maximum value of the absolute value of the voltage value of the head vibration sensor 28 within 5 milliseconds from when it is determined that the percussion is performed becomes a peak value Pzhm. In addition, a maximum value of the absolute value of the voltage value (the output value) of the rim vibration sensor 32 within 5 milliseconds from when it is determined that the percussion is performed on the basis of the voltage waveform of the head vibration sensor 28 becomes a peak value Pzrm.

As the percussion position approaches the central section of the percussion surface 20*a*, the percussion surface 20*a* is easily bent downward and the peak value Pzhm of the head vibration sensor 28 is increased. In addition, since the vibrations due to the percussion on the percussion surface 20*a* are transmitted to the housing 10 from the peripheral section of the percussion surface 20*a*, as the percussion position approaches the central section of the percussion surface 20*a*, a transmission distance of the vibrations from the percussion position to the rim vibration sensor 32 configured to detect the vibrations of the housing 10 is increased, and the peak value Pzrm of the rim vibration sensor 32 is decreased.

The peak value Pzhm of the head vibration sensor 28 is divided by the peak value Pzrm of the rim vibration sensor 32, and a value obtained by multiplying this by a user parameter stored in an adjustment value memory 43*k*, which will be described below, is the peak ratio feature quantity X1. The peak ratio feature quantity X1 is increased as the percussion position approaches the central section of the percussion surface 20*a* and decreased as the percussion position approaches the peripheral section of the percussion surface 20*a* on the basis of the properties of the peak value Pzhm of the head vibration sensor 28 and the peak value Pzrm of the rim vibration sensor 32 aforementioned.

In the voltage waveform of the head vibration sensor 28 on the basis of the percussion on the percussion surface 20*a*, a pitch of an initial half wave in which the percussion surface 20*a* is initially oscillated toward the head vibration sensor 28 (a negative value is taken) is a pitch feature quantity X3. That is, the initial half wave is a portion of the voltage waveform of the head vibration sensor 28 between two points where the voltage value is 0 before and after a position initially intersecting the percussion threshold N1. The pitch feature quantity X3 is increased as the percussion position approaches the central section of the percussion surface 20*a* and decreased as the percussion position approaches the peripheral section of the percussion surface 20*a*. This is because a vibration pattern of the percussion surface 20*a* when the central section of the percussion surface 20*a* is percussed is different from a vibration pattern of the percussion surface 20*a* when the peripheral section of the percussion surface 20*a* is percussed.

Returning to FIG. 3, the RAM 43 is a memory configured to store various pieces of work data, flags, and the like, upon execution of the program such as the control program 42*a* or the like using the CPU 41 in a rewritable manner. The head sensor value ring buffer 43*a*, a rim sensor value ring buffer 43*b*, a pressure sensor value ring buffer 43*c*, a reference value calculation ring buffer 43*d*, an average value memory 43*e*, a reference value memory 43*f*, a percussion processing flag 43*g*, a pressing flag 43*h*, a pressing value memory 43*i*, a feature quantity memory 43*j*, the adjustment value memory 43*k*, and an edge degree memory 43*l* are provided in the RAM 43.

The head sensor value ring buffer 43*a* is a buffer configured to store the output value of the head vibration sensor 28 that has been A/D converted over the previous 5 milliseconds. The rim sensor value ring buffer 43*b* is a buffer configured to store the output value of the rim vibration sensor 32 that is A/D converted for past 5 milliseconds. The pressure sensor value ring buffer 43*c* is a buffer configured to store the output value of the pressure sensor 24 that is A/D converted for past 5 milliseconds.

The head sensor value ring buffer 43*a* and the rim sensor value ring buffer 43*b* are initialized by filling them with 0 upon input of electric power to the electronic percussion instrument 1 and immediately after initialization processing of (a) of FIG. 6 is executed. The pressure sensor value ring buffer 43*c* is initialized by filling it with an invalid value upon input of electric power to the electronic percussion instrument 1 and immediately after initialization processing of (a) of FIG. 6 is executed. The invalid value is a value that cannot be taken due to the structure of the pressure sensor 24. In the embodiment, 1025 that is greater than the maximum value of 1024 of the pressure sensor 24 is held in the pressure sensor value ring buffer upon initialization as an invalid value.

In periodical processing of (b) of FIG. 6, sensor values (output values) in the pressure sensors 24, the head vibration sensors 28 and the rim vibration sensors 32 (hereinafter, expressed as "the sensors 24, 28 and 32") when the periodical processing is executed are added to the head sensor value ring buffer 43*a*, the rim sensor value ring buffer 43*b* and the pressure sensor value ring buffer 43*c* (hereinafter, expressed as "the ring buffers 43*a*, 43*b* and 43*c*") that correspond thereto ((b) of FIG. 6, S10).

Memories configured to store 50 output values of the sensors 24, 28 and 32 and memories configured to store the latest output values among the 50 output values are provided in the ring buffers 43*a*, 43*b* and 43*c*. This is because the following periodical processing in FIG. 7 is executed for each 100 microseconds=0.1 milliseconds and the output values for past 5 milliseconds are stored.

First, the acquired output values are stored in the ring buffers 43*a*, 43*b* and 43*c* in sequence of No. 1 to 50. Then, when output values have been stored up to No. 50, the output values are stored in sequence from No. 1 again. Accordingly, the output values for the maximum past 5 milliseconds are stored in the ring buffers 43*a*, 43*b* and 43*c*. Acquisition of the peak value Pzhm of the head vibration sensor 28, the peak value Pzrm of the rim vibration sensor 32, the peak value Pm of the pressure sensor 24, or the pitch feature quantity X3 that is the pitch of the initial half wave of the head vibration sensor 28 is performed using values of the ring buffers 43*a*, 43*b* and 43*c*.

The reference value calculation ring buffer 43*d* is a buffer configured to store eight output values of the pressure sensor 24 basically acquired at every second for calculating the reference value of the pressure sensor 24. Further, the output value of the pressure sensor 24 stored in the reference value calculation ring buffer 43*d* is different from the output value of the pressure sensor 24 stored in the pressure sensor value ring buffer 43*c*. The output value of the pressure sensor 24 stored in the reference value calculation ring buffer 43*d* is a value obtained by averaging the output values of the pressure sensor 24 for past 0.8 milliseconds stored in the pressure sensor value ring buffer 43*c* at every 0.1 milliseconds in periodical processing. Hereinafter, the output value of the pressure sensor 24 stored in the reference value calculation ring buffer 43*d* is referred to as an average output value of the pressure sensor 24. The average output value of the pressure sensor 24 is referred to as an output value from which electrical noise of the pressure sensor 24 has been removed.

The reference value calculation ring buffer 43*d* is initialized by filling it with "0" upon input of electric power to the electronic percussion instrument 1 and immediately after initialization processing of (a) of FIG. 6 is executed. Then, in the periodical processing of (b) of FIG. 6, when the pressing flag 43*h* is off while the percussion surface 20*a* is not pressed, and a time 1 second or more from the last updating or 10 seconds or more from percussion on the percussion surface 20*a* have elapsed, the average output value of the pressure sensor 24 (the value of the average value memory 43*e*) updated upon the periodical processing is added to the reference value calculation ring buffer 43*d* ((b) of FIG. 6, S24).

A memory configured to store eight average output values of the pressure sensor 24 is provided in the reference value calculation ring buffer 43*d*. First, the average output values acquired in sequence of No. 1 to 8 are stored in the reference value calculation ring buffer 43*d*. Then, when the average output values are stored at No. 8, the average output value is stored in sequence from No. 1 again.

The average value memory 43*e* is a memory configured to store the average output values of the pressure sensor 24. A value of the average value memory 43*e* is initialized to "0" upon input of electric power to the electronic percussion instrument 1 and immediately after the initialization processing of (a) of FIG. 6 is executed. Then, in the periodical processing of (b) of FIG. 6, after a new output value of the pressure sensor 24 is stored in the pressure sensor value ring buffer 43*c* at every 0.1 milliseconds, an average output value of the pressure sensor 24 is calculated by averaging output values of the pressure sensor 24 for past 0.8 milliseconds, and the average output value of the pressure sensor 24 is stored in the average value memory 43*e* ((b) of FIG. 6, S12).

The reference value memory 43*f* is a memory configured to store a reference value of the pressure sensor 24. A value of the reference value memory 43*f* is initialized to an invalid value upon input of electric power of the electronic percussion instrument 1 and immediately after the initialization processing of (a) of FIG. 6 is executed. The invalid value is a value that cannot be taken due to the structure of the pressure sensor 24. Then, in the periodical processing of (b) of FIG. 6, after a new average output value of the pressure sensor 24 is stored in the reference value calculation ring buffer 43*d*, a reference value of the pressure sensor 24 is calculated by averaging eight values of the reference value calculation ring buffer 43*d*, and the reference value is held in the reference value memory 43*f* ((b) of FIG. 6, S25).

As shown in (a) of FIG. 5, the output value of the pressure sensor 24 varies between before and after the percussion surface 20*a* is percussed or pressed. This is because how the elastic body 26 sandwiched between the pressure sensor 24 and the percussion surface 20*a* is deformed and how the percussion surface 20*a* is returned are changed. In addition, the output value of the pressure sensor 24 is varied according to tension applied to the head 20, an ambient temperature, or the like.

For this reason, there is a need to update a reference value of the pressure sensor 24 in the periodical processing of (b) of FIG. 6 at every predetermined updating time. For example, specifically, when describing with reference to (a) of FIG. 5, the output value of the pressure sensor 24 is aligned with the reference value B1 before the percussion surface 20*a* is percussed, and the output value of the pressure sensor 24 stabilizes at a value lower than the reference value B1 after the percussion surface 20*a* is percussed. For this reason, a reference value B2 is provided at the position where a newly stabilized output value of the pressure sensor 24 is aligned.

Further, in stabilizing the output value of the pressure sensor 24, the output value of the pressure sensor 24 is substantially constant, and specifically, a rate of change of the output value of the pressure sensor 24 is within 5%. Here, the pressing is instantly released from a state in which the percussion surface 20*a* is strongly pressed until the output value of the pressure sensor 24 is the lowest (not changed), and a stabilization time until the output value of the pressure sensor 24 stabilizes from release of the pressing is about 10 seconds in the electronic percussion instrument 1 of the embodiment.

Returning to FIG. 3, the percussion processing flag 43*g* is a flag indicating that percussion detection processing based on the percussion on the percussion surface 20*a* is being performed. The percussion processing flag 43*g* is set to OFF indicating that the percussion detection processing is not performed upon input of electric power to the electronic percussion instrument 1 and immediately after the initialization processing of (a) of FIG. 6 is executed. In the periodical processing of (b) of FIG. 6, when an absolute value of the latest value of the head sensor value ring buffer 43*a* (the current output value of the head vibration sensor 28) exceeds the percussion threshold N1, the percussion processing flag 43*g* is set to ON ((b) of FIG. 6, S26). In addition, in the periodical processing in which percussion detection is terminated, the percussion processing flag 43*g* is turned off (FIG. 8, S53).

The pressing flag 43*h* is a flag indicating that the percussion surface 20*a* is being pressed. The pressing flag 43*h* is set to OFF indicating that the percussion surface 20*a* is not being pressed upon input of electric power to the electronic percussion instrument 1 and immediately after the initialization processing of (a) of FIG. 6 is executed. In pressing detection processing of FIG. 7 executed during the periodical processing of (b) of FIG. 6, when a state in which a difference between the reference value and the average output value of the pressure sensor 24 is greater than a pressing threshold N2 has continued for 10 milliseconds while the pressing flag 43*h* is turned off, the pressing flag 43*h* is set to ON (FIG. 7, S40). In addition, when a state in which a difference between the reference value and the average output value of the pressure sensor 24 is equal to or smaller than the pressing threshold N2 while the pressing flag 43*h* is turned ON has continued for 1 millisecond, the pressing flag 43*h* is set to OFF (FIG. 7, S47).

The pressing value memory 43*i* is a memory configured to store a pressing value that is a variation amount of an output value of the pressure sensor 24 due to pressing against the percussion surface 20*a*. A value of the pressing value memory 43*i* is initialized to "0" upon input of electric power to the electronic percussion instrument 1 and immediately after the initialization processing of (a) of FIG. 6 is executed. In the pressing detection processing of FIG. 7, when a difference between the reference value and the average output value of the pressure sensor 24 is greater than the pressing threshold N2 and a value obtained by subtracting the pressing threshold N2 and the average output value of the pressure sensor 24 from the reference value is greater than a movable threshold N3, 127 that is the maximum value of the pressing value is stored in the pressing value memory 43*i* (FIG. 7, S35). In addition, when a difference between the reference value and the average output value of the pressure sensor 24 is greater than the pressing threshold N2 and a value obtained by subtracting the pressing threshold N2 and the average output value of the pressure sensor 24 from the reference value is equal to or smaller than the movable threshold N3, a pressing value is calculated by multiplying the value obtained by subtracting the pressing threshold N2 and the average output value of the pressure sensor 24 from the reference value by 127 and dividing by the movable threshold N3, and the pressing value is stored in the pressing value memory 43*i* (FIG. 7, S36).

The movable threshold N3 is within a range that is secured as a movable amount of the pressing value. Since the pressing value stored in the pressing value memory 43*i* when the value obtained by subtracting the pressing threshold N2 and the average output value of the pressure sensor 24 from the reference value is equal to or smaller than the movable threshold N3 is calculated by multiplying by 127, a region between the value obtained by subtracting the pressing threshold N2 from the reference value and the average output value of the pressure sensor 24 that takes the maximum value of the pressing value on the basis of the movable threshold N3 can be divided into 127 levels. Accordingly, the pressing value can be output to the sound source 45 or the like with 127 levels.

The feature quantity memory 43*j* is a memory configured to store the above-mentioned feature quantities X1, X2 and X3. A value of the feature quantity memory 43*j* is initialized to "0" upon input of electric power to the electronic percussion instrument 1 and immediately after the initialization processing of (a) of FIG. 6 is executed. In the percussion detection processing of FIG. 8 started immediately after the percussion surface 20*a* is percussed, the feature quantities X1, X2 and X3 are calculated and stored in the feature quantity memory 43*j* (FIG. 8, S55, S56 and S57).

The adjustment value memory 43*k* is a memory configured to store a user parameter used for calculation of the peak ratio feature quantity X1. A value of the adjustment value memory 43*k* is initialized to "1" upon input of electric power to the electronic percussion instrument 1 and immediately after the initialization processing of (a) of FIG. 6 is executed. A user parameter of the adjustment value memory 43*k* is changed by operating the operators 15. Further, a flash memory that is not initialized upon input of electric power of the electronic percussion instrument 1 or immediately after the initialization processing of (a) of FIG. 6 is executed may be provided in the control device 40, and the adjustment value memory 43*k* may be provided in the flash memory.

When the user parameter of the adjustment value memory 43*k* is greater than 1, the value of the peak ratio feature quantity X1 is increased and the edge degree E easily approaches 0, and the musical sound when the central section of the percussion surface 20*a* is percussed can be easily produced. When the value of the adjustment value memory 43*k* is smaller than 1, the value of the peak ratio feature quantity X1 is reduced and the edge degree E easily approaches 1, the musical sound when the peripheral section of the percussion surface 20*a* is percussed can be easily produced.

The edge degree memory 43*l* is a memory configured to store the edge degree E showing the percussion position. A value of the edge degree memory 43*l* is initialized to "0" upon input of electric power to the electronic percussion instrument 1 and immediately after the initialization processing of (a) of FIG. 6 is executed. In the percussion detection processing of FIG. 8 started immediately after the percussion surface 20*a* is percussed, the edge degree E is calculated using the feature quantities X1, X2 and X3 stored in the feature quantity memory 43*j* and the weighting factors W1, W2, W3 and b stored in the weighting factor data 42*b*, and the edge degree E is stored in the edge degree memory 43*l* (FIGS. 8, S58 and S59).

Referring to (a) of FIG. 6, the initialization processing executed by the CPU 41 of the electronic percussion instrument 1 will be described. (a) of FIG. 6 is a flowchart of the initialization processing. The initialization processing is executed immediately after input of electric power to the electronic percussion instrument 1, and initialization of memory values (variables) and flags on the RAM 43 is performed (S1). In particular, in the initialization processing, the pressure sensor value ring buffer 43*c* is filled with the invalid value, and the invalid value is held in the reference value memory 43*f*. In addition, in the initialization processing, a reference value updating timer T1, a pressing value updating timer T2, a pressing switching timer T3 and a percussion timer T4, which will be described below, are initialized to "0 second."

Next, referring to (b) of FIG. 6 to FIG. 8, the periodical processing executed by the CPU 41 of the electronic percussion instrument 1 will be described. In the periodical processing, acquisition of the output values of the sensors 24, 28 and 32, and updating of the reference value, the pressing detection processing (FIG. 7), and the percussion detection processing (FIG. 8) are executed at the time the periodical processing is executed, and a sound producing instruction of the musical sound is performed. The periodical processing is repeatedly executed at every 0.1 milliseconds by interval interruption processing at every 0.1 milliseconds.

(b) of FIG. 6 is a flowchart of the periodical processing. In the periodical processing, first, sensor values (output values) of the sensors 24, 28 and 32 are acquired, and added to the ring buffers 43*a*, 43*b* and 43*c* (S10). Since the periodical processing is executed at every 0.1 milliseconds, values of the ring buffers 43*a*, 43*b* and 43*c* are updated at every 0.1 milliseconds.

After the processing of S10, it is checked whether an effective value of 8 or more are held in the pressure sensor value ring buffer 43*c* (for past 0.8 milliseconds) (S11). Further, the effective value is values of 0 to 1024 acquired by the pressure sensors 24. When the effective value of 8 or more is not held in the pressure sensor value ring buffer 43*c* (S11: No), the periodical processing is terminated, and waiting is performed until the effective value of 8 or more is held in the pressure sensor value ring buffer 43*c*, i.e., a time of 0.8 milliseconds or more elapses from the initialization processing.

When the effective value of 8 or more is held in the pressure sensor value ring buffer 43*c* (S11: Yes), values of the pressure sensor 24 for 0.8 milliseconds by going back from the current periodical processing are averaged, and the average output value of the pressure sensor 24 is calculated and held in the value memory 43*e* with reference to the value of the pressure sensor value ring buffer 43*c* (S12). Accordingly, the output value (the average output value) of the pressure sensor 24 from which electric noise is removed is obtained.

After the processing of S12, it is checked whether the value of the reference value memory 43*f* is an effective value (S13). An effective value is values of 0 to 1024 acquired by the pressure sensor 24. Since the invalid value is held in the reference value memory 43*f* during the initialization processing, in the first processing of S13 after the initialization processing, the value of the reference value memory 43*f* is not an effective value (S13: No). In this case, the reference value calculation ring buffer 43*d* is filled with the average output value of the average value memory 43*e* (S14). After that, the average output value of the average value memory 43*e* is held in the reference value memory 43*f* such that the reference value obtained by averaging the values of the reference value calculation ring buffer 43*d* is held in the reference value memory 43*f* (S15). Next, the reference value updating timer T1 showing a time until the value of the reference value memory 43*f* will be updated next is set to 1 second (S16).

In the processing of S13, when the value of the reference value memory 43*f* is an effective value (S13: Yes), the pressing detection processing is executed (S17). In the pressing detection processing, the pressing flag 43*h* is turned ON when the percussion surface 20*a* is being pressed and the pressing flag 43*h* is turned OFF when the percussion surface 20*a* is not being pressed, which will be described later with reference to FIG. 7 below.

After the processing of S17, it is checked whether the percussion processing flag 43*g* indicating that the percussion detection processing of FIG. 8 has started based on the percussion on the percussion surface 20*a* is turned OFF (S18). When the percussion processing flag 43*g* is turned OFF (S18: Yes), it is checked whether the absolute value of the latest value of the head sensor value ring buffer 43*a*, i.e., the absolute value of the output value of the head vibration sensor 28 when the current periodical processing is started is equal to or smaller than the percussion threshold N1 (S19). When the absolute value of the latest value of the head sensor value ring buffer 43*a* is equal to or smaller than the percussion threshold N1 (S19: Yes), since the percussion surface 20*a* is not being percussed, it is checked whether the pressing flag 43*h* indicating that the percussion surface 20*a* is being pressed is turned OFF (S20).

When the pressing flag 43*h* is turned OFF (S20: Yes), 0.1 milliseconds is subtracted from the reference value updating timer T1 (S21). After processing of S21, it is checked whether the reference value updating timer T1 is equal to or smaller than 0 second (S22). When the reference value updating timer T1 is greater than 0 second (S22: No), since the value does not reach the next updating timing after the value of the reference value memory 43*f* is updated, periodical processing is terminated.

When the reference value updating timer T1 is equal to or smaller than 0 second (S22: Yes), 1 second is set to the reference value updating timer T1 (S23), and the average output value of the pressure sensor 24 held in the average value memory 43*e* is added to the reference value calculation ring buffer 43*d* (S24). Next, the reference value is calculated by averaging eight average output values of the pressure sensor 24 stored in the reference value calculation ring buffer 43*d*, the reference value is held in the reference value memory 43*f* (S25), and the periodical processing is terminated.

In this way, since the average output value of the pressure sensor 24 is basically added to the reference value calculation ring buffer 43*d* at every second and the reference value is calculated by averaging the values of the reference value calculation ring buffer 43*d* after the addition, the reference value stored in the reference value memory 43*f* is basically updated at every updating time of 1 second. In addition, since the eight average output values of the pressure sensor 24 basically updated at every second are averaged, the reference value is calculated by averaging the output values of the pressure sensor 24 acquired during a sampling time of 8 seconds.

When the pressing flag 43*h* is turned ON in the processing of S20 (S20: No), since the percussion surface 20*a* is being pressed, 1 second is set to the reference value updating timer T1 (S29), and updating of the reference value of the reference value memory 43*f* is prohibited until 1 second elapses after pressing against the percussion surface 20*a* is released. Since the updating of the reference value is prohibited while the percussion surface 20*a* is being pressed, the pressing value can be prevented from being changed due to updating of the reference value on the basis of a variation of the average output value of the pressure sensor 24 from the reference value. As a result, an appropriate pressing value can be acquired. Further, by prohibiting updating of the reference value after release of the pressing against the percussion surface 20*a*, since the reference value of the reference value memory 43*f* can be updated without using the average output value of the pressure sensor 24 that can be easily changed according to the vibrations of the percussion surface 20*a* according to release of the pressing, the reference value can be appropriately set.

In the processing of S19, when the absolute value of the latest value of the head sensor value ring buffer 43*a* is greater than the percussion threshold N1 (S19: Yes), since the percussion surface 20*a* is percussed, the percussion processing flag 43*g* is turned ON (S26). Next, 10 seconds is set to the reference value updating timer T1 (S27), the percussion detection processing is executed (S28), and the periodical processing is terminated. The percussion detection processing will be described below with reference to FIG. 8. In addition, in the processing of S18, when the percussion processing flag 43*g* is turned ON (S18: No), the percussion detection processing is executed (S28), and the periodical processing is terminated.

In this way, updating of the reference value of the reference value memory 43*f* is prohibited without adding a new average output value of the pressure sensor 24 to the reference value calculation ring buffer 43*d* until 10 seconds that is a stabilization time from when the percussion surface 20*a* is percussed to when vibrations of the percussion surface 20*a* are sufficiently attenuated elapses. As a result, since the reference value of the reference value memory 43*f* can be updated without using the average output value of the pressure sensor 24 that is easily changed according to the percussion surface 20*a* that is greatly vibrated after percussion, the reference value can be appropriately set.

Next, the pressing detection processing (S17) executed during the periodical processing of (b) of FIG. 6 will be described with reference to FIG. 7. In the pressing detection processing, it is determined whether the percussion surface 20*a* is being pressed, the pressing value is calculated when the percussion surface 20*a* is being pressed. More specifically, in the pressing detection processing (the pressing detection unit), the pressing against the percussion surface 20*a* (existence of the pressing or the pressing value) is detected on the basis of the difference between the average output value of the pressure sensor 24 and the reference value.

First, in the pressing detection processing, it is checked whether the difference obtained by subtracting the average output value of the average value memory 43*e* from the reference value of the reference value memory 43*f* is greater than the pressing threshold N2 (S30). When the difference obtained by subtracting the average output value of the average value memory 43*e* from the reference value of the reference value memory 43*f* is greater than the pressing threshold N2 (S30: Yes), since the percussion surface 20*a* may be percussed, the processing from S31 to S36 is executed, and the pressing value is calculated.

In the processing of S31, 0.1 milliseconds is added to the pressing value updating timer T2 that is initialized to 0 second through the initialization processing or the like. The pressing value updating timer T2 shows a time until the pressing value is updated next while it is determined that the percussion surface 20*a* may be pressed (S30: Yes). After the processing of S31, it is checked whether the pressing value updating timer T2 is 1 millisecond (S32). When the pressing value updating timer T2 is less than 1 millisecond (S32: No), since the timing to update the pressing value next has not arrived, processing from S33 to S36 is skipped.

When the pressing value updating timer T2 is 1 millisecond (S32: Yes), since a decrease in average output value of the average value memory 43*e* is likely to be caused by the pressing against the percussion surface 20*a* and the timing of updating the pressing value has arrived, first, the pressing value updating timer T2 is initialized to 0 second in order to update the next pressing value (S33). After the processing of S33, it is checked whether the value obtained by subtracting the pressing threshold N2 and the average output value of the average value memory 43*e* from the reference value of the reference value memory 43*f* is greater than the movable threshold N3 (S34).

When the value obtained by subtracting the pressing threshold N2 and the average output value of the average value memory 43*e* from the reference value of the reference value memory 43*f* is greater than the movable threshold N3 (S34: Yes), since the percussion surface 20*a* is being sufficiently strongly pressed, 127 that is the maximum value of the pressing value is held in the pressing value memory 43*i* (S35).

Meanwhile, when the value obtained by subtracting the pressing threshold N2 and the average output value of the average value memory 43*e* from the reference value of the reference value memory 43*f* is equal to or smaller than the movable threshold N3 (S34: No), in order to express the pressing value with 127 levels, the pressing value expressed by an equation of "(reference value of reference value memory 43*f*−pressing threshold N2−average output value of average value memory 43*e*)×127/movable threshold N3" is held in the pressing value memory 43*i* (S36). Accordingly, it is possible to control the musical sound according to the 127 levels.

In the processing of S30, when the percussion surface 20*a* may be pressed on the basis of a decrease in average output value of the average value memory 43*e* (S30: Yes), after the processing from S31 to S36 is executed, it is checked whether the pressing flag 43*h* showing that the percussion surface 20*a* is being pressed is turned OFF (S37). When the pressing flag 43*h* is turned ON (S37: No), since there is no need to switch the pressing flag 43*h*, the pressing switching timer T3 is initialized to 0 second (S42), and the pressing detection processing is terminated.

When the pressing flag 43*h* is turned OFF (S37: Yes), since it is determined whether the decrease in average output value of the average value memory 43*e* is caused by the pressing or caused by the percussion, first, 0.1 milliseconds is added to the pressing switching timer T3 that is initialized to 0 second due to the initialization processing or the like (S38). The pressing switching timer T3 shows a time until the pressing flag 43*h* is switched according to a variation in average output value of the average value memory 43*e*.

After the processing of S38, it is checked whether the pressing switching timer T3 is 10 milliseconds (S39). When the pressing switching timer T3 is less than 10 milliseconds (S39: No), since the decrease in average output value of the average value memory 43*e* may be caused by the percussion, the pressing detection processing is terminated.

When the pressing switching timer T3 is 10 milliseconds (S39: Yes), since the average output value of the average value memory 43*e* is continuously decreased for 10 milliseconds, it is determined that the decrease in average output value is caused by the pressing, the pressing flag 43*h* is turned ON (S40), the pressing switching timer T3 is initialized to 0 second (S41), and the pressing detection processing is terminated.

In the processing of S30, when the difference obtained by subtracting the average output value of the average value memory 43*e* from the reference value of the reference value memory 43*f* is equal to or smaller than the pressing threshold N2 (S30: No), since the percussion surface 20*a* may not be pressed, the pressing value updating timer T2 is initialized to 0 second (S43). The percussion surface 20*a* is likely to be pressed due to the previous periodical processing (S30: Yes), and when clocking by the pressing value updating timer T2 is started, since the decrease in average output value of the average value memory 43*e* in the periodical processing that has reached to start the clocking by the pressing value updating timer T2 increases probability of the percussion without pressing against the percussion surface 20*a*, the pressing value updating timer T2 is initialized, and the pressing value is not calculated.

After the processing of S43, it is checked whether the pressing flag 43*h* is turned ON (S44). The percussion surface 20*a* may not be pressed (S30: No), and when the pressing flag 43*h* is turned OFF (S44: No), since there is no need to switch the pressing flag 43*h*, the pressing switching timer T3 is initialized to 0 second (S42), and the pressing detection processing is terminated.

Further, the percussion surface 20*a* may be pressed by the previous periodical processing (S30: Yes), and when the clocking by the pressing switching timer T3 is started to switch the pressing flag 43*h*, since the decrease in average output value of the average value memory 43*e* in the periodical processing that has reached to start the clocking by the pressing switching timer T3 increases probability of the percussion without pressing against the percussion surface 20*a*, the pressing switching timer T3 is initialized to prepare for the next switching of the pressing flag 43*h*.

In the processing of S44, when the pressing flag 43*h* is turned ON (S44: Yes), since it is determined whether the increase in average output value of the average value memory 43*e* is caused by release of the pressing, first, 0.1 milliseconds is added to the pressing switching timer T3 (S45).

After the processing of S45, it is checked whether the pressing switching timer T3 is 1 millisecond (S46). When the pressing switching timer T3 is less than 1 millisecond (S46: No), since the increase in average output value of the average value memory 43*e* may be caused by the percussion on the percussion surface 20*a* or the noise, the pressing detection processing is terminated.

Further, in the periodical processing after the clocking by the pressing switching timer T3 is started through the processing of S45 and S46, before the pressing switching timer T3 becomes 1 millisecond, when the difference obtained by subtracting the average output value of the average value memory 43*e* from the reference value of the reference value memory 43*f* is greater than the pressing threshold N2 (S30: Yes), the pressing switching timer T3 is initialized to 0 second in the processing of S42, and the pressing detection processing is terminated.

In the processing of S46, when the pressing switching timer T3 is 1 millisecond (S46: Yes), since the average output value of the average value memory 43*e* is continuously increased for 1 millisecond, it is determined that the increase in average output value is caused by release of the pressing, the pressing flag 43*h* is turned OFF (S47), the pressing switching timer T3 is initialized to 0 second (S48), and the pressing detection processing is terminated.

As described above, in the pressing detection processing, it waits 10 milliseconds when the pressing flag 43*h* is switched from OFF to ON, and it waits 1 millisecond when the pressing flag 43*h* is switched from ON to OFF. Even when the percussion surface 20*a* is percussed in a state in which the percussion surface 20*a* is being pressed, since the percussion surface 20*a* is difficult to vibrate, the average output value of the pressure sensor 24 is hard to rise, and the vibrations of the percussion surface 20*a* are attenuated early. On the other hand, when the percussion surface 20*a* is percussed in a state in which the percussion surface 20*a* is not pressed, the percussion surface 20*a* is easily vibrated, and a time until the vibrations are sufficiently attenuated is long. Accordingly, it is possible to reliably determine that the percussion surface 20*a* is pressed by lengthening the waiting time when the pressing flag 43*h* is switched from OFF to ON while improving responsiveness by shortening the waiting time when the pressing flag 43*h* is switched from ON to OFF.

Next, the percussion detection processing (S28) executed during the periodical processing of (b) of FIG. 6 will be described with reference to FIG. 8. The percussion detection processing is processing executed on the basis of the percussion on the percussion surface 20*a*, the percussion position on the percussion surface 20*a* is calculated, and a sound producing instruction of the musical sound is output.

First, in the percussion detection processing, 0.1 milliseconds is added to the percussion timer T4 that is initialized to 0 second through the initialization processing or the like (S50). The percussion timer T4 shows an elapsed time after the absolute value of the latest value of the head sensor value ring buffer 43*a* exceeds the percussion threshold N1 ((b) of FIG. 6, S20: Yes).

After the processing of S50, it is checked whether the percussion timer T4 is 5 milliseconds (S51). When the percussion timer T4 is less than 5 milliseconds (S51: No), since a time required to acquire a peak value of the sensors 24, 28 and 32 does not elapse, the processing from S52 to S60 is skipped, and the percussion detection processing is terminated.

In the processing of S51, when the percussion timer T4 is 5 milliseconds (S51: Yes), since the time required to acquire the peak value of the sensors 24, 28 and 32 has elapsed, first, the percussion timer T4 is initialized to 0 second (S52), and the percussion processing flag 43*g* is turned OFF (S53) in preparation for when the percussion surface 20*a* is percussed next and the percussion detection processing is executed.

After the processing of S53, within 5 milliseconds from the values of the ring buffers 43*a*, 43*b* and 43*c*, the peak value Pzhm of the head vibration sensors 28, the peak value Pzrm of the rim vibration sensors 32, and the peak value Pm of the pressure sensors 24 are acquired (S54, a peak value acquisition unit). Next, the peak ratio feature quantity X1 is calculated on the basis of an equation of "peak ratio feature quantity X1=peak value Pzhm×user parameter of adjustment value memory 43*k*/peak value Pzrm," and held in the feature quantity memory 43*j* (S55).

After processing of S55, the pressure-sensitive peak feature quantity X2 is calculated on the basis of an equation of "pressure-sensitive peak feature quantity X2=reference value of reference value memory 43*f*-peak value Pm," and held in the feature quantity memory 43*j* (S56). After that, a pitch of an initial half wave of the head vibration sensor 28 is calculated from the value of the head sensor value ring buffer 43*a* as the pitch feature quantity X3, and held in the feature quantity memory 43*j* (S57, a pitch acquisition unit).

After the processing of S57, the temporary edge degree A is calculated from an equation of "A=W1×X1+W2×X2+W3×X3+b" using the feature quantities X1, X2 and X3 held in the feature quantity memory 43*j* and the weighting factors W1, W2, W3 and b held in the weighting factor data 42*b* (S58). Next, the edge degree E expressed by "E=1/(1+exp(−A))" is calculated by substituting the temporary edge degree A into the standard sigmoid function, and held in the edge degree memory 43*l* (S59). The processing from S54 to S59 is a position calculating unit (a position calculating process) configured to calculate the percussion position according to the output values of the sensors 24, 28 and 32.

After the processing of S59, the edge degree E of the edge degree memory 43*l*, the state of the pressing flag 43*h*, the pressing value of the pressing value memory 43*i*, and the instruction for production of the musical sound according to the values of the ring buffers 43*a*, 43*b* and 43*c* are output to the sound source 45 (S60), and the percussion detection processing is terminated.

The sound source 45 calculates an intensity of the percussion on the percussion surface 20*a* or a vibration state of the percussion surface 20*a* according to the values of the ring buffers 43*a*, 43*b* and 43*c*, and outputs the musical sound signal according to the intensity of the percussion or the vibration state. In addition, the sound source 45 outputs a normal musical sound signal showing that the percussion surface 20*a* is not pressed when the pressing flag 43*h* is turned OFF. Meanwhile, the sound source 45 outputs a musical sound signal showing that the vibrations of the percussion surface 20*a* are attenuated early according to the pressing value when the pressing flag 43*h* is turned ON.

The sound source 45 outputs a musical sound signal when the central section of the percussion surface 20*a* is percussed in the case in which the edge degree E is 0, and outputs a musical sound signal when the peripheral section of the percussion surface 20*a* is percussed in the case in which the edge degree E is 1. When the edge degree E is from 0 to 1, the sound source 45 outputs the musical sound signal showing that a ratio between a magnitude from 0 to the edge degree E and a magnitude from the edge degree E to 1 is equal to a volume ratio between the musical sound when the central section is percussed and the musical sound when the peripheral section is percussed.

In the above-mentioned electronic percussion instrument (musical sound generating apparatus) 1, since the elastic body 26 is compressed between the percussion surface 20*a* and the pressure sensor 24, there is no gap between the percussion surface 20*a* and the pressure sensor 24, and the output value of the pressure sensor 24 can be changed even when the percussion surface 20*a* is not strongly pressed. Since there is no gap and the output value of the pressure sensor 24 is changed even when the percussion surface 20*a* is not pressed or percussed, when the reference value provided to determine whether the percussion surface 20*a* is pressed or calculate the pressing amount (the pressing value) of the percussion surface 20*a* is constant, it is difficult to correctly perform determination of the pressing or calculation of the pressing value.

However, in the embodiment, basically, the reference value of the pressure sensor 24 is updated according to the output value of the pressure sensor 24 at every updating time of 1 second set to the reference value updating timer T1. Accordingly, it is possible to correctly perform determination of the pressing or calculation of the pressing value. As a result, sensitivity of the pressing against the percussion surface 20*a* can be improved.

The updating time of 1 second set to the reference value updating timer T1 is about 0.1 times of 10 seconds that is a stabilization time of the electronic percussion instrument 1 of the embodiment. Further, as described above, the stabilization time is a time when the pressing is instantly released from a state in which the percussion surface 20*a* is strongly pressed until the output value of the pressure sensor 24 is lowest (not changed) and until the output value of the pressure sensor 24 stabilizes from release of the pressing. The output value of the pressure sensor 24 is likely to be largely changed immediately after percussion on the percussion surface 20*a* or immediately after release of the pressing, and a time zone in which the change is large is increased as the stabilization time is increased. Here, since the updating time is 0.1 times or more of the stabilization time, it is difficult to acquire the output value of the pressure sensor 24 that is largely changed immediately after percussion on the percussion surface 20*a* or immediately after release of the pressing, and the reference value can be appropriately set. As a result, sensitivity of the pressing against the percussion surface 20*a* can be further improved.

In addition, the updating time is preferably 0.5 times or less of the stabilization time, and the updating time is preferably 0.3 times or less of the stabilization time. As the updating time is short, since the reference value can approach early the value at which the pressure sensor 24 stabilizes, sensitivity of the pressing against the percussion surface 20*a* can be improved.

The reference value is calculated by averaging the average output values of the pressure sensor 24 held in the reference value calculation ring buffer 43*d* at a predetermined timing in the periodical processing. That is, the reference value is calculated by averaging the average output values of the pressure sensor 24 acquired at a predetermined sampling time. Accordingly, even when the output value of the pressure sensor 24 is temporarily largely changed by the vibrations of the percussion surface 20*a* or various noises after percussion on the percussion surface 20*a* or after release of the pressing, the reference value can be appropriately set by calculating the reference value by averaging the output values.

The average output value of the pressure sensor 24 is stored (held) in the reference value calculation ring buffer (the storage unit) 43*d* at every updating time. Accordingly, a new average output value of the pressure sensor 24 after the updating time is stored, the newly stored average output value and the average output value stored past of the pressure sensor 24 are averaged, and thus, the reference value can be calculated. For this reason, since the average output value of the pressure sensor 24 may not be continuously stored for the sampling time, a storage capacity of the average output value of the pressure sensor 24 can be reduced.

Since the eight average output values of the pressure sensor 24 are stored in the reference value calculation ring buffer 43*d* and a new average output value is stored in the reference value calculation ring buffer 43*d* at every updating time of 1 second, a basic sampling time is 8 seconds. The sampling time of 8 seconds is 0.8 times of the stabilization time of 10 seconds.

When the sampling time is 0.8 times or more of the stabilization time until the percussion surface 20*a* stabilizes from a state in which the percussion surface 20*a* is most greatly oscillated, the sampling time with respect to the stabilization time is set long enough. Accordingly, even when the percussion surface 20*a* is temporarily largely vibrated during the sampling time, the output value of the pressure sensor 24 when the vibrations are sufficiently attenuated can be acquired. For this reason, the reference value can be more appropriately set.

In addition, the sampling time is preferably 2 times or less of the stabilization time, and the sampling time is preferably 1.5 times or less of the stabilization time. As the sampling time is short, since it is difficult for the pressure sensor 24 before percussion to use the stabilized value and it is easy for the pressure sensor 24 after percussion to use the stabilized value, the reference value can be more appropriately set.

The electronic percussion instrument 1 prohibits updating of the reference value until the stabilization time of 10 seconds elapses from when the percussion surface 20*a* is percussed. As a result, since the reference value can be updated without using the average output value of the pressure sensor 24 that can be easily changed by the percussion surface 20*a* that is largely vibrated after percussion, the reference value can be appropriately set.

Prohibition of the updating of the reference value from when the percussion surface 20*a* is percussed is executed by temporarily setting the updating time of the reference value updating timer T1 showing the time until the reference value is updated next to 10 seconds after percussion. Accordingly, the processing of prohibiting the updating of the reference value can be simplified.

In addition, the updating of the reference value may be prohibited until the stabilization time or more elapses from when the percussion surface 20*a* is percussed. The updating of the reference value is preferably prohibited until 2 times or less of the stabilization time elapses, and the updating of the reference value is more preferably prohibited until 1.3 times or less of the stabilization time elapses. Since the time of prohibiting the updating of the reference value is reduced, when the percussion surface 20*a* is continuously percussed, a time zone in which the reference value cannot be updated can be reduced, and the reference value can be appropriately set.

The electronic percussion instrument 1 prohibits the updating of the reference value until 1 second elapses after the pressing against the percussion surface 20*a* is released while the percussion surface 20*a* is being pressed. Accordingly, as described above, an appropriate pressing value can be acquired, and the reference value can be appropriately set. Prohibition of the updating of the reference value is executed by setting the updating time of the reference value updating timer T1 showing the time until the reference value is updated next to 1 second at every time through the periodical processing while the percussion surface 20*a* is being pressed. Accordingly, the processing for prohibiting the updating of the reference value can be simplified.

Further, since 0.1 milliseconds is not subtracted from the reference value updating timer T1 through the periodical processing at every time while the percussion surface 20*a* is being pressed or during the percussion processing, the updating of the reference value is prohibited while the percussion surface 20*a* is being pressed or after the percussion. As a result, the processing for prohibiting the updating of the reference value can be further simplified.

In addition, the updating of the reference value may be prohibited until 0.1 times of the stabilization time (in the embodiment, 1 second) or more elapses after release of the pressing against the percussion surface 20*a*. Since the vibrations of the percussion surface 20*a* after release of the pressing are attenuated early to be smaller than the vibrations when the percussion surface 20*a* is percussed, when the time of prohibiting the updating of the reference value after release of the pressing against the percussion surface 20*a* is 0.1 times or more of the stabilization time, the reference value can be appropriately set.

Further, the time of prohibiting the updating of the reference value after release the pressing against the percussion surface 20*a* is preferably 0.5 times or less of the stabilization time and more preferably 0.3 times or less of the stabilization time. Since the time of prohibiting the updating of the reference value is reduced, responsiveness of the updating of the reference value after release of the pressing against the percussion surface 20*a* can be improved.

The electronic percussion instrument 1 calculates the percussion position on the percussion surface 20*a* according to the output value of the pressure sensor 24, the output value of the head vibration sensor 28 and the output value of the rim vibration sensor 32. Since the pressure sensor 24 detects the pressing against the central section of the percussion surface 20*a*, as the percussion position approaches the central section, the output value of the pressure sensor 24 is likely to increase. Since the head vibration sensor 28 detects the vibrations of the peripheral section other than the central section of the percussion surface 20*a*, the output value of the pressure sensor 24 according to the percussion position is likely to be different from the output value of the head vibration sensor 28. Further, since the head vibration sensor 28 and the rim vibration sensor 32 overlap each other when seen in a plan view, it is easy to make the ratio of these output values constant for each percussion position. The electronic percussion instrument 1 can improve detection accuracy of the percussion position using these output values even when the percussion position spreads or becomes multiple. In particular, the electronic percussion instrument 1 can simulate renditions of a conga, bongo, or the like, the percussion surface 20*a* of which is percussed by the hands, where the percussion position easily spreads or becomes multiple.

Further, the electronic percussion instrument 1 calculates the edge degree E as the percussion position according to the peak ratio feature quantity X1 that is a ratio of the peak value Pzhm of the head vibration sensor 28 and the peak value Pzrm of the rim vibration sensor 32, the pressure-sensitive peak feature quantity X2 that is a peak of the displacement amount from the reference value of the pressure sensor 24, and the pitch feature quantity X3 that is a pitch of the initial half wave of the head vibration sensor 28. Each of the feature quantities X1, X2 and X3 is easily changed according to the percussion position as described above. Since the edge degree E is calculated using the feature quantities X1, X2 and X3, detection accuracy of the percussion position can be improved.

In particular, the weighting factors W1, W2, W3 and b calculated upon design of a product of the electronic percussion instrument 1 and determined on the basis of a shape or the like of the electronic percussion instrument 1 are used in calculation of the edge degree E. Specifically, the edge degree E is calculated on the basis of the temporary edge degree A which is a sum of products of the weighting factors W1, W2 and W3 showing importance of the feature quantities X1, X2 and X3 and the feature quantities X1, X2 and X3 corresponding thereto, and further summing the weighting factor b as a constant term. Accordingly, detection accuracy of the percussion position can be further improved upon design of each product of the electronic percussion instrument 1, i.e., each shape of the electronic percussion instrument 1. Further, since the weighting factors W1, W2, W3 and b are calculated by actually percussing the electronic percussion instrument 1 at a design step, detection accuracy of the percussion position can be further improved even when the percussion position spreads or becomes plural.

The edge degree E calculated by substituting the temporary edge degree A into the standard sigmoid function takes a numeral of 0 or more and 1 or less. For this reason, in the case in which the edge degree E is a value from 0 to 1, when a musical sound signal obtained by mixing the musical sound signal when the central section of the percussion surface 20*a* is percussed and the musical sound signal when the peripheral section is percussed is output according to the ratio therebetween, a volume ratio of the musical sound signal is easily set.

Next, a second embodiment will be described with reference to FIG. 9 to FIG. 11. In the first embodiment, the electronic percussion instrument 1 that simulates a bongo has been described. On the other hand, in the second embodiment, a MIDI controller (a musical sound generating apparatus) 80 configured to perform input to an electronic musical instrument or the like will be described. Further, the same components as described in the first embodiment are designated by the same reference signs, and description thereof will be omitted.

First, the entire configuration of the MIDI controller 80 will be described with reference to (a) of FIG. 9 and (b) of FIG. 9. (a) of FIG. 9 is a plan view of the MIDI controller 80 according to the second embodiment. (b) of FIG. 9 is a cross-sectional view of the MIDI controller 80 taken along line IXb-IXb of (a) of FIG. 9. Further, in order to make understanding easier, a left side, a right side, a lower side and an upper side of the drawing of (a) of FIG. 9 indicate a leftward side, a rightward side, a forward side (on the side of a player), a back side of the MIDI controller 80, respectively, and an upper side and a lower side of the drawing of (b) of FIG. 9 indicate an upward side and a downward side of the MIDI controller 80, respectively.

As shown in (a) of FIG. 9, the MIDI controller 80 is an apparatus for detecting that percussion surfaces 83 are percussed (pressed) using pressure sensors (percussion detection units) 24 and outputting an instruction based on the percussion to the outside. The MIDI controller 80 includes a housing 81 having a rectangular parallelepiped shape, a plurality of operators 82 provided on both of left and right sides of the housing 81, sixteen percussion surfaces 83 provided on the housing 81, sixteen elastic bodies 84 having upper surfaces on which the percussion surfaces 83 are formed, and the pressure sensors 24 configured to detect percussion on the percussion surfaces 83. Further, in (a) of FIG. 9, regions in which the plurality of operators 82 is provided are surrounded by two-dot dashed lines, and illustration of the operators 82 is omitted. The sixteen percussion surfaces 83 and the sixteen elastic bodies 84 are arranged in 4 rows×4 columns. Further, in (a) of FIG. 9, reference sign designates only one percussion surface 83 and only one elastic body 84 of a left lower side.

As shown in (b) of FIG. 9, opening holes 81*a* are formed in the upper surface of the housing 81 at positions corresponding to the percussion surfaces 83. A control device 90 configured to output a percussion instruction is built into the housing 81. The pressure sensors 24 are provided on the upper surface of the control device 90 to be disposed inward from inner circumferential edges of the opening holes 81*a*.

The elastic bodies 84 are members formed of a rubber, which cover the pressure sensors 24 from above. The elastic bodies 84 overhang upward from the opening holes 81*a*, and the percussion surfaces 83 are formed by the upper surfaces of the overhanging elastic bodies 84. Rubber films 85 that abut the inside of the housing 81 of edges of the opening holes 81*a* extend from side surfaces of the elastic bodies 84. Since rubber films 85 abut the inside of the housing 81, upward displacement of the elastic bodies 84 is restricted.

In a state in which the upward displacement is restricted, the elastic bodies 84 are pressed against the pressure sensors 24. In (b) of FIG. 9, the elastic body 84 in a state in which a load is not app lied is shown by a two-dot dashed line. When the percussion surface 83 is percussed, the pressure sensor 24 is pressed via the elastic body 84, and the percussion is detected by the pressure sensor 24. A lower surface of the elastic body 84 abutting the pressure sensor 24 is formed in a shape thinned downward such that a contact area between the pressure sensor 24 and the elastic body 84 is increased as the pressure sensor 24 is strongly pressed. Accordingly, an output value of the pressure sensor 24 is easily changed according to intensity of the percussion of the percussion surface 83.

Further, since the elastic bodies 84 are compressed between the percussion surfaces 83 and the pressure sensors 24, there is no gap between the percussion surfaces 83 and the pressure sensors 24, and the output values of the pressure sensors 24 can be changed even when the percussion surfaces 83 are not strongly pressed. Accordingly, sensitivity of the pressure sensors 24 with respect to percussion (pressing) on the percussion surfaces 83 can be improved.

In the MIDI controller 80, the pressing is instantly released from a state in which the percussion surfaces 83 are strongly pressed until the output values of the pressure sensors 24 are lowest (not changed), and the stabilization time until the output values of the pressure sensors 24 are stabilized from release of the pressing is about 1 second. Since a portion of the MIDI controller 80 that vibrates after release of the pressing is the elastic bodies 84 formed of a rubber, which are difficult to vibrate in comparison with the head 20 of the first embodiment, the stabilization time of the MIDI controller 80 is smaller than the stabilization time of the electronic percussion instrument 1 of the first embodiment.

Next, an electrical configuration of the MIDI controller 80 will be described with reference to FIG. 10. FIG. 10 is a block diagram showing the electrical configuration of the MIDI controller 80. The control device 90 of the MIDI controller 80 has a CPU 91, a ROM 92 and a RAM 93, which are connected to each other via bus lines 94. In addition, the sixteen pressure sensors 24 provided on the sixteen percussion surfaces 83, respectively, the operators 82, and an output part 95 are connected to the bus lines 94. A PC 96 is connected to the output part 95, and a speaker 97 is connected to the PC 96.

The MIDI controller 80 outputs the percussion instruction according to the detection result (the output value) of the pressure sensors 24 based on the percussion to the PC 96 from the CPU 41 via the output part 95 when the percussion surfaces 83 are percussed. In the PC 96, music is created on the basis of the percussion instruction from the output part 95, or tone colors or various effects are added to the percussion instruction. After that, the musical sound based on a musical sound signal output from the PC 96 is emitted from the speaker 97.

The CPU 91 is an arithmetic operation apparatus for controlling the respective parts connected via the bus lines 94. The ROM 92 is a non-rewritable memory. A control program 92*a* is stored in the ROM 92. When the control program 92*a* is executed by the CPU 91, the initialization processing is executed immediately after input of electric power to the MIDI controller 80, and then, the periodical processing is executed. The initialization processing is the same as the initialization processing of (a) of FIG. 6 according to the first embodiment.

The RAM 93 is a memory configured to store various work data, flags, and the like, upon execution of the program such as the control program 92*a* or the like by the CPU 91 in a rewritable manner. The pressure sensor value ring buffer 43*c*, the reference value calculation ring buffer 43*d*, the average value memory 43*e*, the reference value memory 43*f*, the percussion processing flag 43*g*, the previous average value memory 93*a*, and a percussion level memory 93*b* are provided in the RAM 93.

The previous average value memory 93*a* is a memory configured to store values of the average value memory 43*e* before the values of the average value memory 43*e* are updated. The values of the previous average value memory 93*a* are initialized to "0" upon input of electric power to the MIDI controller 80 and immediately after the initialization processing is executed. In the periodical processing of FIG. 11, before the value of the average value memory 43*e* is updated, the current value of the average value memory 43*e* is held in the previous average value memory 93*a* (FIG. 11, S72).

The percussion level memory 93*b* is a memory configured to store a percussion level showing a peak of a displacement amount from a reference value of the pressure sensors 24 as intensity of percussion. The value of the percussion level memory 93*b* is initialized to "0" upon input of electric power to the MIDI controller 80 and immediately after the initialization processing is executed. In the periodical processing of FIG. 11, after 2 milliseconds elapses from percussion on the percussion surfaces 83, the peak of the displacement amount from the reference value of the pressure sensors 24 within 2 milliseconds is stored in the percussion level memory 93*b* as a percussion level (FIG. 11, S88).

Next, the periodical processing executed by the CPU 91 of the MIDI controller 80 will be described with reference to FIG. 11. In the periodical processing, acquisition of the output value of the pressure sensors 24 when the periodical processing is executed, the updating of the reference value, or calculation of the percussion level is executed. The periodical processing is repeatedly executed at every 0.1 milliseconds by the interval interruption processing at every 0.1 milliseconds.

FIG. 11 is a flowchart of the periodical processing. In the periodical processing, first, sensor values (output values) of the pressure sensors 24 are acquired, and added to the pressure sensor value ring buffer 43*c* (S70). Since the periodical processing is executed at every 0.1 milliseconds, the value of the pressure sensor value ring buffer 43*c* is updated at every 0.1 milliseconds.

After the processing of S70, it is checked whether an effective value of 8 or more is held in the pressure sensor value ring buffer 43*c* (S71). Further, the effective value is a value of 0 to 1024 acquired by the pressure sensors 24. When the effective value of 8 or more is not held in the pressure sensor value ring buffer 43*c* (S71: No), it waits until the periodical processing is terminated and the effective value of 8 or more is held in the pressure sensor value ring buffer 43*c*, i.e., 0.8 milliseconds or more elapses from the initialization processing.

When the effective value of 8 or more is held in the pressure sensor value ring buffer 43*c* (S71: Yes), the value of the average value memory 43*e* is held in the previous average value memory 93*a* (S72). Next, the values of the pressure sensors 24 for 0.8 milliseconds are averaged retroactively from the current periodical processing with reference to the value of the pressure sensor value ring buffer 43*c*, and the average output value of the pressure sensors 24 is calculated and stored in the average value memory 43*e* (S73). Accordingly, the output value (the average output value) of the pressure sensors 24, from which electric noises are removed, is obtained.

After the processing of S73, it is checked whether the value of the reference value memory 43*f* is an effective value (S74). The effective value is a value from 0 to 1024 acquired by the pressure sensors 24. Since an invalid value is held in the reference value memory 43*f* during the initialization processing, in the first processing of S74 after the initialization processing, the value of the reference value memory 43*f* is not the effective value (S74: No). In this case, the reference value calculation ring buffer 43*d* is filled with the value of the average value memory 43*e* (S75). After that, the value of the average value memory 43*e* is held in the reference value memory 43*f* such that the reference value obtained by averaging the values of the reference value calculation ring buffer 43*d* is held in the reference value memory 43*f* (S76). Next, 0.1 second is set to the reference value updating timer T1 showing a time until the value of the reference value memory 43*f* is updated next (S77).

In the processing of S74, when the value of the reference value memory 43*f* is the effective value (S74: Yes), 0.1 milliseconds is subtracted from the reference value updating timer T1 (S78). After the processing of S78, it is checked whether the percussion processing flag 43*g* showing that the processing is started based on the percussion on the percussion surfaces 83 is turned OFF (S79).

When the percussion processing flag 43*g* is turned OFF (S79: Yes), since the processing based on the percussion (pressing) is not started, it is checked whether a difference obtained by subtracting the current output value (the latest value of the pressure sensor value ring buffer 43*c*) of the pressure sensors 24 from the value of the previous average value memory 93*a* is greater than a percussion threshold N4 (S80). In the processing of S80, when output value of the pressure sensors 24 in the present periodical processing is much lower than the value of the average value memory 43*e* till the previous periodical processing in which the percussion is not performed (the value of the previous average value memory 93*a*) by the percussion threshold N4, it is determined that the percussion surfaces 83 are percussed.

In the processing of S80, since the percussion surfaces 83 are percussed when the difference obtained by subtracting the latest value of the pressure sensor value ring buffer 43*c* from the value of the previous average value memory 93*a* is greater than the percussion threshold N4 (S80: Yes), the percussion processing flag 43*g* is turned ON (S81), and 1 second is set to the reference value updating timer T1 (S82).

After the processing of S82, 0.1 milliseconds is added to the percussion timer T4 that is initialized to 0 second through the initialization processing or the like (S83). The percussion timer T4 shows a time elapsed after it is determined that the percussion surfaces 83 are percussed. After the processing of S83, it is checked whether the percussion timer T4 is 2 milliseconds (S84). When the percussion timer T4 is less than 2 milliseconds (S84: No), since a time required to acquire the peak value Pm of the pressure sensors 24 does not elapse, the periodical processing is terminated. In the next periodical processing, since the percussion processing flag 43*g* is turned ON (S79: Yes), 0.1 milliseconds is added to the percussion timer T4 through the processing of S83, and it waits until the percussion timer T4 becomes 2 milliseconds.

In the processing of S84, when the percussion timer T4 is 2 milliseconds (S84: Yes), since a time required to acquire the peak value Pm of the pressure sensors 24 elapses, first, the percussion timer T4 is initialized to 0 second (S85) and the percussion processing flag 43*g* is turned OFF in preparation for the next percussion of the percussion surfaces 83 (S86).

After the processing of S86, the peak value Pm of the pressure sensors 24 within 2 milliseconds is calculated from the value of the pressure sensor value ring buffer 43*c* (S87).

Next, the percussion level (the peak value feature quantity X2 in (a) of FIG. 5) is calculated by subtracting the peak value Pm from the reference value of the reference value memory 43*f*, and the percussion level is held in the percussion level memory 93*b* (S88). In this way, in the processing (the pressing detection unit, the pressing detecting process) of S88, the pressing against the percussion surfaces 83 is detected as a percussion level on the basis of the difference between the output value (the peak value Pm) of the pressure sensors 24 and the reference value. After the processing of S88, percussion information (a percussion instruction) according to a percussion level of the percussion level memory 93*b* is transmitted to the PC 96 via the output part 95 (S89), and the periodical processing is terminated.

In the processing of S80, when the difference obtained by subtracting the latest value of the pressure sensor value ring buffer 43*c* from the value of the previous average value memory 93*a* is equal to or smaller than the percussion threshold N4 (S80: No), since the percussion surfaces 83 are not percussed, it is shifted to the processing of updating the reference value. In the processing of updating the reference value, first, it is checked whether the reference value updating timer T1 is equal to or less than 0 second (S90). When the reference value updating timer T1 is greater than 0 second (S90: No), since the timing of updating the value of the reference value memory 43*f* does not arrive after the value is updated, the periodical processing is terminated.

When the reference value updating timer T1 is equal to or smaller than 0 second (S90: Yes), since it is timing of updating the reference value, 0.1 seconds is set to the reference value updating timer T1 (S91), and the average output value of the pressure sensors 24 stored in the average value memory 43*e* is added to the reference value calculation ring buffer 43*d* (S92). Next, the reference value is calculated by averaging the total eight average output values of the pressure sensors 24 stored in the reference value calculation ring buffer 43*d*, the reference value is held in the reference value memory 43*f* (S93), and the periodical processing is terminated.

Similar to the first embodiment, in the above-mentioned MIDI controller (musical sound generating apparatus) 80, since the elastic bodies 84 are compressed between the percussion surfaces 83 and the pressure sensors 24, there is no gap between the percussion surfaces 83 and the pressure sensors 24, and the output value of the pressure sensors 24 can be changed even when the percussion surfaces 83 are not strongly percussed (pressed). Further, basically, since the reference value of the pressure sensors 24 is updated according to the output value of the pressure sensors 24 at every updating time of 0.1 seconds that is set to the reference value updating timer T1, determination of the pressing or calculation of the pressing value can be correctly performed. As a result, sensitivity of the pressing against the percussion surfaces 83 can be improved.

The updating time of 0.1 seconds basically set to the reference value updating timer T1 when the percussion surfaces 83 are not percussed is 0.1 times of 1 second that is the stabilization time of the MIDI controller 80. Accordingly, similar to the first embodiment, the reference value can be appropriately set.

In addition, since the eight average output values of the pressure sensors 24 are stored in the reference value calculation ring buffer 43*d* and a new average output value is basically stored in the reference value calculation ring buffer 43*d* at every updating time of 0.1 seconds, the basic sampling time is 0.8 seconds. The reference value is calculated by averaging the average output values of the pressure sensors 24 acquired during the sampling time that is 0.8 times of the stabilization time of the MIDI controller 80. As a result, similar to the first embodiment, the reference value can be appropriately set.

Hereinabove, while the disclosure has been described based on the embodiments, the disclosure is not limited to the above-mentioned embodiments, and various modifications may be made without departing from the spirit of the disclosure. For example, shapes, dimensions, or elements of the housing 10 or the heads 20 and 21 may be appropriately modified. The speaker 17 may be omitted from the electronic percussion instrument 1, and the electronic percussion instrument 1 may be connected to an external speaker. The updating time of the reference value or the sampling time of acquiring the output value of the pressure sensor configured to update the reference value may be appropriately modified.

In the first embodiment, while the electronic percussion instrument 1 that simulates a bongo has been described, the embodiment is not particularly limited thereto. The disclosure may be applied to an electronic percussion instrument that simulates another percussion instrument such as a snare drum, a bass drum, a cymbal, a conga, or the like. In addition, the disclosure may also be applied to a musical sound generating apparatus that performs an operation of percussion or pressing (pushing) such as an input apparatus, an electronic keyboard instrument, or the like, in addition to the MIDI controller 80.

In the first embodiment, while the case in which the elastic body 26 is an elastic member formed of sponge has been described, it is not particularly limited thereto. The elastic body 26 may be formed of an elastic material such as a rubber or a thermoplastic elastomer. In addition, the elastic bodies 84 of the second embodiment may be formed of sponge or a thermoplastic elastomer. In addition, the cushion 30 may be formed of a rubber or a thermoplastic elastomer.

In the first embodiment, while the case in which the percussion position on the percussion surface 20*a* can be calculated according to the output value of the pressure sensors 24, the output value of the head vibration sensors 28 and the output value of the rim vibration sensors 32 has been described, it is not particularly limited thereto. The vibrations of the percussion surface 20*a* may be detected by the head vibration sensors 28 while existence of the pressing against the percussion surface 20*a* or the pressing amount by a stick or the like is detected by the pressure sensors 24. Accordingly, it is possible to simulate a stick shot that hits a stick pressed against the percussion surface 20*a* with another stick, or a rendition that percusses the percussion surface 20*a* with another stick or hands in a state in which the percussion surface 20*a* is pressed with a stick or hands. Since ratios of the output values of the rim vibration sensors 32 with respect to the output values of the pressure sensors 24 or the head vibration sensors 28 are different in the stick shot in which the pressed place is equal to the percussion position and the rendition in which the pressed place is different from the percussion position, differences in these renditions can be distinguished.

In the first embodiment, while the case in which the percussion position (the edge degree E) is calculated according to the feature quantities X1, X2 and X3 has been described, it is not particularly limited thereto. For example, the percussion position may be calculated according to a time difference between the peak value of the pressure sensors 24, the peak value of the head vibration sensors 28 and the peak value of the rim vibration sensors 32. In addition, the percussion position may be calculated using a ratio between the peak value of the pressure sensors 24 and the peak value of the head vibration sensors 28 or a ratio between the peak value of the pressure sensors 24 and the peak value of the rim vibration sensors 32.

In the first embodiment, while the case in which the head vibration sensors 28 and the rim vibration sensors 32 are formed of piezoelectric elements has been described, it is not particularly limited thereto. The head vibration sensors 28 and the rim vibration sensors 32 may be formed of a dynamo-electric or electrostatic capacitance contact type detection element or non-contact type detection element. In addition, the contact type head vibration sensors 28 may be directly attached to the heads 20 and 21. The pressure sensor 24 is not limited to a piezo-resistance type such as a pressure-sensitive resistor element or the like, and the pressure sensor 24 may be a capacitance type.

In the embodiment, while the case in which the output value of the pressure sensors 24 is reduced as the pressure applied to the pressure sensors 24 is increased, i.e., the percussion surface 20*a* are strongly pressed or percussed has been described, it is not particularly limited thereto. A configuration in which the output value of the pressure sensors 24 is increased as the pressure applied to the pressure sensors 24 is increased may be provided. Even in any case, in the first embodiment, when an absolute value of the difference between the reference value and the output value (the average output value) of the pressure sensors 24 is greater than the pressing threshold N2, it is determined that the percussion surface 20*a* is pressed. Further, even in any case, in the embodiments, an absolute value of the difference between the peak value Pm of the pressure sensors 24 and the reference value is the feature quantity X2 or the percussion level.

In addition, even in any case, in the second embodiment, when the absolute value of the difference between the output value of the pressure sensors 24 (the latest value of the pressure sensor value ring buffer 43*c*) and the output value (the average output value) of the pressure sensors 24 till the previous periodical processing is greater than the percussion threshold N4, it is determined that the percussion surfaces 83 are percussed. When the output value of the pressure sensors 24 is increased as the pressure applied to the pressure sensors 24 is increased, in the first embodiment, the pressing value is calculated by subtracting the value obtained by adding the pressing threshold N2 to the reference value from the output value (the average output value) of the pressure sensors 24. Further, the pressing value may be calculated on the basis of the absolute value of the difference between the reference value and the output value (the average output value) of the pressure sensors 24 without using the pressing threshold N2 in calculation of the pressing value.

In the first embodiment, while the case in which the current output values of the sensors 24, 28 and 32 are acquired from the latest values of the ring buffers 43*a*, 43*b* and 43*c* corresponding thereto has been described, it is not particularly limited thereto. The memories configured to store the current output values of the sensors 24, 28 and 32 may be separately provided on the ring buffers 43*a*, 43*b* and 43*c*.

In addition, while the case in which the peak values of the sensors 24, 28 and 32 are calculated from the values of the ring buffers 43*a*, 43*b* and 43*c* corresponding thereto has been described, it is not particularly limited thereto. When the current output values of the sensors 24, 28 and 32 are greater than the peak values of the sensors 24, 28 and 32 held until the previous time at every periodical processing during a predetermined time (for example, for 5 milliseconds) from percussion on the percussion surface 20*a*, the peak values of the sensors 24, 28 and 32 may be updated.

In the first embodiment, while the case in which it is determined that the percussion surface 20*a* may be pressed when the difference obtained by subtracting the average output value of the pressure sensors 24 from the reference value is greater than the pressing threshold N2 has been described, it is not particularly limited thereto. When the average output value of the pressure sensors 24 is smaller than the reference value, it may be determined that the percussion surface 20*a* may be pressed. However, in this case, the reference value may be a value that is slightly greater than the value obtained by averaging the eight average output values of the pressure sensors 24 held in the pressure sensor value ring buffer 43*c*.

In the second embodiment, while the case in which it is determined that the percussion surfaces 83 is percussed (pressed) when the difference obtained by subtracting the latest value of the pressure sensor value ring buffer 43*c* from the value of the previous average value memory 93*a* is greater than the percussion threshold N4 has been described, it is not particularly limited thereto. It may be determined that the percussion surfaces 83 are percussed (pressed) on the basis of the difference between the reference value and the latest value of the pressure sensor value ring buffer 43*c*.

In the embodiment, while the case in which the weighting factors W1, W2, W3 and b are calculated and stored in the weighting factor data 42*b* as fixed values upon shipment of products by supervised learning of machine learning at every design of products of the electronic percussion instrument 1 has been described, it is not particularly limited thereto. The weighting factors W1, W2, W3 and b may be calculated by machine learning using data when a user percusses the percussion surface 20*a*. In this case, since the region of the central section of the percussion surface 20*a* in which the edge degree E becomes 0 and the region of the peripheral section of the percussion surface 20*a* in which the edge degree E becomes 1 can be set to each user, the user can easily generate desired musical sound.

In the embodiment, while the case in which the pressure sensors 24 are disposed on the central section of the percussion surface 20*a* on the side of the back surface 20*b*, the head vibration sensors 28 are disposed on the peripheral section of the percussion surface 20*a* on the side of the back surface 20*b*, and the rim vibration sensors 32 are disposed at the position overlapping the head vibration sensors 28 when seen in a plan view of the percussion surface 20*a* has been described, it is not particularly limited thereto. The positions of the sensors 24, 28 and 32 may be appropriately changed. Since the weighting factors W1, W2, W3 and b corresponding to the output values of the sensors 24, 28 and 32 are calculated by machine learning according to the positions of the sensors 24, 28 and 32, calculation accuracy of the percussion position (the edge degree E) can be improved.

In the first embodiment, while the case in which 0.1 milliseconds is not subtracted from the reference value updating timer T1 through every periodical processing while the percussion surface 20*a* is being pressed or during the percussion processing has been described, it is not particularly limited thereto. Since 1 second or 10 seconds is set to the reference value updating timer T1 during pressing or after percussion on the percussion surface 20*a*, 0.1 milliseconds may be subtracted from the reference value updating timer T1 through every periodical processing while the percussion surface 20*a* is pressed or during the percussion processing.

What is claimed is:

1. An electronic percussion instrument, comprising:

a housing;

a percussion surface attached to the housing;

a pressure sensor disposed on a central section of the percussion surface on a side of a back surface and configured to detect pressing against the central section;

a head vibration sensor disposed on a peripheral section of the percussion surface on the side of the back surface and configured to detect vibrations of the peripheral section;

a rim vibration sensor disposed at a position that overlaps the head vibration sensor when seen in a plan view of the percussion surface and configured to detect vibrations of the housing; and a control device configured to output a sound producing instruction according to percussion on the percussion surface, wherein two percussion surfaces are provided in one housing, and the pressure sensor, the head vibration sensor and the rim vibration sensor are disposed with respect to each of the percussion surfaces, the control device comprises a crosstalk cancellation unit configured to prevent the sound producing instruction from being output on the basis of vibrations due to crosstalk when it is determined that vibrations generated on one percussion surface of the two percussion surfaces are caused due to crosstalk generated on the basis of the vibrations of the other percussion surface by comparing an output value of the head vibration sensor configured to detect the vibrations of the one percussion surface with an output value of the head vibration sensor configured to detect the vibrations of the other percussion surface.

2. The electronic percussion instrument according to claim 1, wherein the crosstalk cancellation unit removes a vibration element of the one percussion surface due to crosstalk generated on the basis of the vibrations of the other percussion surface according to a crosstalk amount by comparing the output value of the head vibration sensor of the one percussion surface with the output value of the head vibration sensor of the other percussion surface when a percussion position on the one percussion surface is calculated according to the output value of the head vibration sensor of the one percussion surface.

3. The electronic percussion instrument according to claim 1, wherein the crosstalk cancellation unit calculates, by comparing an output value of the rim vibration sensor of the one percussion surface of the two percussion surfaces with an output value of the rim vibration sensor of the other percussion surface, an element of the output value of the rim vibration sensor of the one percussion surface due to crosstalk generated on the basis of the vibrations of the other percussion surface, and removes the element of the output value of the rim vibration sensor of the one percussion surface due to crosstalk generated on the basis of the vibrations of the other percussion surface according to the crosstalk amount when the percussion position on the one percussion surface is calculated according to the output value of the rim vibration sensor of the one percussion surface.

4. The electronic percussion instrument according to claim 1, comprising a control device configured to output a sound producing instruction according to percussion on the percussion surface, wherein the control device comprises a position calculating unit configured to calculate a percussion position on the percussion surface according to an output value of the pressure sensor, an output value of the head vibration sensor, and an output value of the rim vibration sensor.

5. The electronic percussion instrument according to claim 4, wherein the control device comprises:

a peak value acquisition unit configured to acquire a pressure-sensitive peak feature quantity that is a peak value of a displacement amount from a reference value of the pressure sensor, a peak value of the head vibration sensor, and a peak value of the rim vibration sensor within a predetermined time from when the percussion surface is percussed; and a pitch acquisition unit configured to acquire a pitch feature quantity that is a pitch of an initial half wave of the output waveform of the head vibration sensor within the predetermined time at which the percussion surface is initially vibrated toward the head vibration sensor, and the position calculating unit calculates the percussion position on the percussion surface according to a peak ratio feature quantity that is a ratio between the peak value of the head vibration sensor and the peak value of the rim vibration sensor that are acquired by the peak value acquisition unit, the pressure-sensitive peak feature quantity acquired by the peak value acquisition unit, and the pitch feature quantity acquired by the pitch acquisition unit.

6. The electronic percussion instrument according to claim 5, wherein the control device comprises weighting factor data in which weighting factors corresponding to feature quantities used in calculation of the percussion position by the position calculating unit are stored, and the position calculating unit calculates the percussion position on the percussion surface according to a value calculated by summing products of the weighting factors stored in the weighting factor data and the feature quantities corresponding thereto.

7. The electronic percussion instrument according to claim 1, comprising a control device configured to output a sound producing instruction according to percussion on the percussion surface, wherein the control device comprises a pressing detection unit configured to determine whether the percussion surface is being pressed, and detects existence of pressing against the percussion surface or calculates a pressing value on the basis of a difference between an average output value of the pressure sensor and a reference value when the percussion surface is being pressed.

8. A musical sound generating method of outputting a sound producing instruction according to a percussion position on a percussion surface attached to a housing of an electronic percussion instrument, the musical sound generating method comprising:

a position calculating process of calculating the percussion position on the percussion surface according to an output value of a pressure sensor configured to detect pressing against the percussion surface, an output value of a head vibration sensor configured to detect vibrations of the percussion surface, and an output value of a rim vibration sensor configured to detect vibrations of the housing within a predetermined time from when the percussion surface is percussed, and a crosstalk cancellation process of, when two percussion surfaces are provided in one housing, and the pressure sensor, the head vibration sensor and the rim vibration sensor are disposed with respect to each of the percussion surfaces, preventing the sound producing instruction from being output on the basis of vibrations due to crosstalk when it is determined that vibrations generated on one percussion surface of the two percussion surfaces are caused due to crosstalk generated on the basis of the vibrations of the other percussion surface by comparing an output value of the head vibration sensor configured to detect the vibrations of the one percussion surface with an output value of the head vibration sensor configured to detect the vibrations of the other percussion surface.

9. The musical sound generating method according to claim 8, wherein, in the crosstalk cancellation process, when a percussion position on the one percussion surface is calculated according to the output value of the head vibration sensor of the one percussion surface, a vibration element of the one percussion surface due to crosstalk generated on the basis of the vibrations of the other percussion surface is removed according to a crosstalk amount by comparing the output value of the head vibration sensor of the one percussion surface with the output value of the head vibration sensor of the other percussion surface.

10. The musical sound generating method according to claim 8, wherein, in the crosstalk cancellation process, by comparing an output value of the rim vibration sensor of the one percussion surface of the two percussion surfaces with an output value of the rim vibration sensor of the other percussion surface, an element of the output value of the rim vibration sensor of the one percussion surface due to crosstalk generated on the basis of the vibrations of the other percussion surface is calculated, and when the percussion position on the one percussion surface is calculated according to the output value of the rim vibration sensor of the one percussion surface, the element of the output value of the rim vibration sensor of the one percussion surface due to crosstalk generated on the basis of the vibrations of the other percussion surface is removed according to the crosstalk amount.

11. The musical sound generating method according to claim 8, comprising:

a peak value acquisition process of acquiring a pressure-sensitive peak feature quantity that is a peak value of a displacement amount from a reference value of the pressure sensor, a peak value of the head vibration sensor, and a peak value of the rim vibration sensor within the predetermined time from when the percussion surface is percussed; and a pitch acquisition process of acquiring a pitch feature quantity that is a pitch of an initial half wave of the output waveform of the head vibration sensor within the predetermined time at which the percussion surface is initially vibrated toward the head vibration sensor, wherein, in the position calculating process, the percussion position on the percussion surface is calculated according to a peak ratio feature quantity that is a ratio between the peak value of the head vibration sensor and the peak value of the rim vibration sensor that are acquired in the peak value acquisition process, the pressure-sensitive peak feature quantity acquired in the peak value acquisition process, and the pitch feature quantity acquired in the pitch acquisition process.

12. The musical sound generating method according to claim 11, wherein weighting factor data in which weighting factors corresponding to feature quantities used in calculation of the percussion position in the position calculating process are stored is provided, and in the position calculating process, the percussion position on the percussion surface is calculated according to a value calculated by summing products of the weighting factors stored in the weighting factor data and the feature quantities corresponding thereto.

13. The musical sound generating method according to claim 8, comprising a pressing detecting process of determining whether the percussion surface is being pressed, and detecting existence of pressing against the percussion surface or calculating a pressing value on the basis of a difference between an average output value of the pressure sensor and a reference value when the percussion surface is being pressed.

* * * * *